US008044314B2

(12) United States Patent
Weber et al.

(10) Patent No.: US 8,044,314 B2
(45) Date of Patent: Oct. 25, 2011

(54) HYBRID BUTTON

(75) Inventors: Douglas J. Weber, Arcadia, CA (US); Pinida Jan Moolsintong, San Francisco, CA (US); Stephen P. Zadesky, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/844,502

(22) Filed: Jul. 27, 2010

(65) Prior Publication Data

US 2010/0313409 A1 Dec. 16, 2010

Related U.S. Application Data

(62) Division of application No. 11/519,259, filed on Sep. 11, 2006, now Pat. No. 7,795,553.

(51) Int. Cl.
*H01H 13/02* (2006.01)

(52) U.S. Cl. ..... 200/341; 200/5 R

(58) Field of Classification Search ..... 200/5 R, 200/5 A, 341–345
See application file for complete search history.

(56) References Cited

U.S. PATENT DOCUMENTS

| | | | | |
|---|---|---|---|---|
| 1,061,578 | A | | 5/1913 | Wischhusen et al. |
| 2,063,276 | A | | 12/1936 | Thomas |
| 2,798,907 | A | | 7/1957 | Schneider |
| 2,903,229 | A | | 9/1959 | Landge |
| 2,945,111 | A | | 7/1960 | McCormick |
| 3,005,055 | A | | 10/1961 | Mattke |
| 3,965,399 | A | | 6/1976 | Walker et al. |
| 3,996,441 | A | | 12/1976 | Ohashi |
| 4,029,915 | A | * | 6/1977 | Ojima ..... 708/145 |
| 4,103,252 | A | | 7/1978 | Bobick |
| 4,110,749 | A | | 8/1978 | Janko et al. |
| 4,115,670 | A | | 9/1978 | Chandler |
| 4,121,204 | A | | 10/1978 | Welch et al. |
| 4,129,747 | A | | 12/1978 | Pepper |
| 4,158,216 | A | | 6/1979 | Bigelow |
| 4,242,676 | A | | 12/1980 | Piguet et al. |
| 4,246,452 | A | | 1/1981 | Chandler |
| 4,264,903 | A | | 4/1981 | Bigelow |
| 4,266,144 | A | | 5/1981 | Bristol |
| 4,293,734 | A | | 10/1981 | Pepper, Jr. |

(Continued)

FOREIGN PATENT DOCUMENTS

| | | |
|---|---|---|
| CN | 1139235 | 1/1997 |

(Continued)

OTHER PUBLICATIONS

Ng et al., U.S. Office Action mailed Dec. 9, 2010, directed to U.S. Appl. No. 11/394,493; 13 pages.

(Continued)

*Primary Examiner* — Michael Friedhofer
(74) *Attorney, Agent, or Firm* — Morrison & Foerster LLP

(57) ABSTRACT

A hybrid button according to the invention is provided. In one embodiment, the button can be implemented in an electronic device such as a media player. The button can include a metal or other non-plastic portion having a reverse flange and a plastic portion including anti-rotation legs. The legs can prevent rotation at least in part because they are retained by another structure. The plastic portion can be injection-molded onto the reverse flange of the metal or non-plastic portion. As such, the reverse flange fixes the position of the plastic portion with respect to the metal portion. Finally, the metal portion can include an actuator nub that actuates a switch when the button is depressed.

17 Claims, 6 Drawing Sheets

U.S. PATENT DOCUMENTS

| | | | | | |
|---|---|---|---|---|---|
| D264,969 | S | | 6/1982 | McGourty | |
| 4,338,502 | A | * | 7/1982 | Hashimoto et al. | 200/512 |
| 4,380,007 | A | | 4/1983 | Steinegger | |
| 4,380,040 | A | | 4/1983 | Posset | |
| 4,394,649 | A | | 7/1983 | Suchoff et al. | |
| 4,475,008 | A | | 10/1984 | Doi et al. | |
| 4,570,149 | A | | 2/1986 | Thornburg et al. | |
| 4,583,161 | A | | 4/1986 | Gunderson et al. | |
| 4,587,378 | A | | 5/1986 | Moore | |
| 4,604,786 | A | | 8/1986 | Howie, Jr. | |
| 4,613,736 | A | * | 9/1986 | Shichijo et al. | 200/317 |
| 4,644,100 | A | | 2/1987 | Brenner et al. | |
| 4,719,524 | A | | 1/1988 | Morishima et al. | |
| 4,734,034 | A | | 3/1988 | Maness et al. | |
| 4,736,191 | A | | 4/1988 | Matzke et al. | |
| 4,739,191 | A | | 4/1988 | Puar | |
| 4,739,299 | A | | 4/1988 | Eventoff et al. | |
| 4,752,655 | A | | 6/1988 | Tajiri et al. | |
| 4,755,765 | A | | 7/1988 | Ferland | |
| 4,764,717 | A | | 8/1988 | Tucker et al. | |
| 4,771,139 | A | * | 9/1988 | DeSmet | 200/5 A |
| 4,798,919 | A | | 1/1989 | Miessler et al. | |
| 4,810,992 | A | | 3/1989 | Eventoff | |
| 4,822,957 | A | | 4/1989 | Talmage, Jr. et al. | |
| 4,831,359 | A | | 5/1989 | Newell | |
| 4,849,852 | A | | 7/1989 | Mullins | |
| 4,856,993 | A | | 8/1989 | Maness et al. | |
| 4,860,768 | A | | 8/1989 | Hon et al. | |
| 4,866,602 | A | | 9/1989 | Hall | |
| 4,876,524 | A | | 10/1989 | Jenkins | |
| 4,897,511 | A | | 1/1990 | Itaya et al. | |
| 4,914,624 | A | | 4/1990 | Dunthorn | |
| 4,917,516 | A | | 4/1990 | Retter | |
| 4,943,889 | A | | 7/1990 | Ohmatoi | |
| 4,951,036 | A | | 8/1990 | Grueter et al. | |
| 4,954,823 | A | | 9/1990 | Binstead | |
| 4,976,435 | A | | 12/1990 | Shatford et al. | |
| 4,990,900 | A | | 2/1991 | Kikuchi | |
| 5,008,497 | A | | 4/1991 | Asher | |
| 5,036,321 | A | | 7/1991 | Leach et al. | |
| 5,053,757 | A | | 10/1991 | Meadows | |
| 5,086,870 | A | | 2/1992 | Bolduc | |
| 5,125,077 | A | | 6/1992 | Hall | |
| 5,159,159 | A | | 10/1992 | Asher | |
| 5,179,648 | A | | 1/1993 | Hauck | |
| 5,186,646 | A | | 2/1993 | Pederson | |
| 5,192,082 | A | | 3/1993 | Inoue et al. | |
| 5,193,669 | A | * | 3/1993 | Demeo et al. | 200/512 |
| 5,231,326 | A | | 7/1993 | Echols | |
| 5,237,311 | A | | 8/1993 | Mailey et al. | |
| 5,278,362 | A | | 1/1994 | Ohashi | |
| 5,305,017 | A | | 4/1994 | Gerpheide | |
| 5,313,027 | A | | 5/1994 | Inoue et al. | |
| D349,280 | S | | 8/1994 | Kaneko | |
| 5,339,213 | A | | 8/1994 | O'Callaghan | |
| 5,367,199 | A | | 11/1994 | Lefkowitz et al. | |
| 5,374,787 | A | | 12/1994 | Miller et al. | |
| 5,379,057 | A | | 1/1995 | Clough et al. | |
| 5,404,152 | A | | 4/1995 | Nagai | |
| 5,408,621 | A | | 4/1995 | Ben-Arie | |
| 5,414,445 | A | | 5/1995 | Kaneko et al. | |
| 5,416,498 | A | | 5/1995 | Grant | |
| 5,424,756 | A | | 6/1995 | Ho et al. | |
| 5,432,531 | A | | 7/1995 | Calder et al. | |
| 5,438,331 | A | | 8/1995 | Gilligan et al. | |
| D362,431 | S | | 9/1995 | Kaneko et al. | |
| 5,450,075 | A | | 9/1995 | Waddington | |
| 5,453,761 | A | | 9/1995 | Tanaka | |
| 5,473,343 | A | | 12/1995 | Kimmich et al. | |
| 5,473,344 | A | | 12/1995 | Bacon et al. | |
| 5,479,192 | A | | 12/1995 | Carroll, Jr. et al. | |
| 5,494,157 | A | | 2/1996 | Golenz et al. | |
| 5,495,566 | A | | 2/1996 | Kwatinetz | |
| 5,508,703 | A | | 4/1996 | Okamura et al. | |
| 5,508,717 | A | | 4/1996 | Miller | |
| 5,543,588 | A | | 8/1996 | Bisset et al. | |
| 5,543,591 | A | | 8/1996 | Gillespie et al. | |
| 5,555,004 | A | | 9/1996 | Ono et al. | |
| 5,559,301 | A | | 9/1996 | Bryan, Jr. et al. | |
| 5,559,943 | A | | 9/1996 | Cyr et al. | |
| 5,561,445 | A | | 10/1996 | Miwa et al. | |
| 5,564,112 | A | | 10/1996 | Hayes et al. | |
| 5,565,887 | A | | 10/1996 | McCambridge et al. | |
| 5,578,817 | A | | 11/1996 | Bidiville et al. | |
| 5,581,670 | A | | 12/1996 | Bier et al. | |
| 5,585,823 | A | | 12/1996 | Duchon et al. | |
| 5,589,856 | A | | 12/1996 | Stein et al. | |
| 5,589,893 | A | | 12/1996 | Gaughan et al. | |
| 5,596,347 | A | | 1/1997 | Robertson et al. | |
| 5,596,697 | A | | 1/1997 | Foster et al. | |
| 5,598,183 | A | | 1/1997 | Robertson et al. | |
| 5,611,040 | A | | 3/1997 | Brewer et al. | |
| 5,611,060 | A | | 3/1997 | Belfiore et al. | |
| 5,613,137 | A | | 3/1997 | Bertram et al. | |
| 5,617,114 | A | | 4/1997 | Bier et al. | |
| 5,627,531 | A | | 5/1997 | Posso et al. | |
| 5,632,679 | A | | 5/1997 | Tremmel | |
| 5,640,258 | A | | 6/1997 | Kurashima et al. | |
| 5,648,642 | A | | 7/1997 | Miller et al. | |
| D382,550 | S | | 8/1997 | Kaneko et al. | |
| 5,657,012 | A | | 8/1997 | Tait | |
| 5,661,632 | A | | 8/1997 | Register | |
| D385,542 | S | | 10/1997 | Kaneko et al. | |
| 5,675,362 | A | | 10/1997 | Clough et al. | |
| 5,689,285 | A | | 11/1997 | Asher | |
| 5,721,849 | A | | 2/1998 | Amro | |
| 5,726,687 | A | | 3/1998 | Belfiore et al. | |
| 5,729,219 | A | | 3/1998 | Armstrong et al. | |
| 5,730,165 | A | | 3/1998 | Philipp | |
| 5,748,185 | A | | 5/1998 | Stephan et al. | |
| 5,751,274 | A | | 5/1998 | Davis | |
| 5,754,890 | A | | 5/1998 | Holmdahl et al. | |
| 5,764,066 | A | | 6/1998 | Novak et al. | |
| 5,777,605 | A | | 7/1998 | Yoshinobu et al. | |
| 5,786,818 | A | | 7/1998 | Brewer et al. | |
| 5,790,769 | A | | 8/1998 | Buxton et al. | |
| 5,798,752 | A | | 8/1998 | Buxton et al. | |
| 5,805,144 | A | | 9/1998 | Scholder et al. | |
| 5,808,602 | A | | 9/1998 | Sellers | |
| 5,812,239 | A | | 9/1998 | Eger | |
| 5,812,498 | A | | 9/1998 | Terés | |
| 5,815,141 | A | | 9/1998 | Phares | |
| 5,825,351 | A | | 10/1998 | Tam | |
| 5,825,352 | A | | 10/1998 | Bisset et al. | |
| 5,825,353 | A | | 10/1998 | Will | |
| 5,828,364 | A | | 10/1998 | Siddiqui | |
| 5,838,304 | A | | 11/1998 | Hall | |
| 5,841,078 | A | | 11/1998 | Miller et al. | |
| 5,841,423 | A | | 11/1998 | Carroll, Jr. et al. | |
| D402,281 | S | | 12/1998 | Ledbetter et al. | |
| 5,850,213 | A | | 12/1998 | Imai et al. | |
| 5,856,645 | A | * | 1/1999 | Norton | 200/61.53 |
| 5,856,822 | A | | 1/1999 | Du et al. | |
| 5,859,629 | A | | 1/1999 | Tognazzini | |
| 5,861,875 | A | | 1/1999 | Gerpheide | |
| 5,869,791 | A | | 2/1999 | Young | |
| 5,875,311 | A | | 2/1999 | Bertram et al. | |
| 5,883,619 | A | | 3/1999 | Ho et al. | |
| 5,889,236 | A | | 3/1999 | Gillespie et al. | |
| 5,889,511 | A | | 3/1999 | Ong et al. | |
| 5,894,117 | A | | 4/1999 | Kamishima | |
| 5,903,229 | A | | 5/1999 | Kishi | |
| 5,907,152 | A | | 5/1999 | Dandliker et al. | |
| 5,907,318 | A | | 5/1999 | Medina | |
| 5,909,211 | A | | 6/1999 | Combs et al. | |
| 5,910,802 | A | | 6/1999 | Shields et al. | |
| 5,914,706 | A | | 6/1999 | Kono | |
| 5,923,388 | A | | 7/1999 | Kurashima et al. | |
| D412,940 | S | | 8/1999 | Kato et al. | |
| 5,933,102 | A | | 8/1999 | Miller et al. | |
| 5,933,141 | A | | 8/1999 | Smith | |
| 5,936,619 | A | | 8/1999 | Nagasaki et al. | |
| 5,943,044 | A | | 8/1999 | Martinelli et al. | |
| 5,953,000 | A | | 9/1999 | Weirich | |
| 5,956,019 | A | | 9/1999 | Bang et al. | |
| 5,959,610 | A | | 9/1999 | Silfvast | |
| 5,959,611 | A | | 9/1999 | Smailagic et al. | |

5,964,661 A 10/1999 Dodge
5,973,668 A 10/1999 Watanabe
6,000,000 A 12/1999 Hawkins et al.
6,002,093 A * 12/1999 Hrehor et al. ..... 200/345
6,002,389 A 12/1999 Kasser et al.
6,005,299 A 12/1999 Hengst
6,025,832 A 2/2000 Sudo et al.
6,031,518 A 2/2000 Adams et al.
6,034,672 A 3/2000 Gaultier et al.
6,057,829 A 5/2000 Silfvast
6,075,533 A 6/2000 Chang
6,084,574 A 7/2000 Bidiville
D430,169 S 8/2000 Scibora
6,097,372 A 8/2000 Suzuki
6,104,790 A 8/2000 Narayanaswami
6,122,526 A 9/2000 Parulski et al.
6,124,587 A 9/2000 Bidiville et al.
6,128,006 A 10/2000 Rosenberg et al.
6,131,048 A 10/2000 Sudo et al.
6,141,068 A 10/2000 Iijima
6,147,856 A 11/2000 Karidis
6,163,312 A 12/2000 Furuya
6,166,721 A 12/2000 Kuroiwa et al.
6,179,496 B1 1/2001 Chou
6,181,322 B1 1/2001 Nanavati
D437,860 S 2/2001 Suzuki et al.
6,188,391 B1 2/2001 Seely et al.
6,188,393 B1 2/2001 Shu
6,191,774 B1 2/2001 Schena et al.
6,198,054 B1 3/2001 Janniere
6,198,473 B1 3/2001 Armstrong
6,211,861 B1 4/2001 Rosenberg et al.
6,219,038 B1 4/2001 Cho
6,222,528 B1 4/2001 Gerpheide et al.
D442,592 S 5/2001 Ledbetter et al.
6,225,976 B1 5/2001 Yates et al.
6,225,980 B1 5/2001 Weiss et al.
6,226,534 B1 5/2001 Aizawa
6,227,966 B1 5/2001 Yokoi
D443,616 S 6/2001 Fisher et al.
6,243,078 B1 6/2001 Rosenberg
6,243,080 B1 6/2001 Molne
6,243,646 B1 6/2001 Ozaki et al.
6,248,017 B1 6/2001 Roach
6,254,477 B1 7/2001 Sasaki et al.
6,256,011 B1 7/2001 Culver
6,259,491 B1 7/2001 Ekedahl et al.
6,262,717 B1 7/2001 Donohue et al.
6,262,785 B1 7/2001 Kim
6,266,050 B1 7/2001 Oh et al.
6,285,211 B1 9/2001 Sample et al.
D448,810 S 10/2001 Goto
6,297,795 B1 10/2001 Kato et al.
6,297,811 B1 10/2001 Kent et al.
6,300,946 B1 10/2001 Lincke et al.
6,307,539 B2 10/2001 Suzuki
D450,713 S 11/2001 Masamitsu et al.
6,314,483 B1 11/2001 Goto et al.
6,321,441 B1 11/2001 Davidson et al.
6,323,845 B1 11/2001 Robbins
D452,250 S 12/2001 Chan
6,340,800 B1 1/2002 Zhai et al.
D454,568 S 3/2002 Andre et al.
6,357,887 B1 3/2002 Novak
D455,793 S 4/2002 Lin
6,373,265 B1 4/2002 Morimoto et al.
6,373,470 B1 4/2002 Andre et al.
6,377,530 B1 4/2002 Burrows
6,396,523 B1 5/2002 Segal et al.
6,424,338 B1 7/2002 Anderson
6,429,846 B2 8/2002 Rosenberg et al.
6,429,852 B1 8/2002 Adams et al.
6,452,514 B1 9/2002 Philipp
6,465,271 B1 10/2002 Ko et al.
6,473,069 B1 10/2002 Gerpheide
6,492,602 B2 12/2002 Asai et al.
6,492,979 B1 12/2002 Kent et al.
6,496,181 B1 12/2002 Bomer et al.
6,497,412 B1 12/2002 Bramm
D468,365 S 1/2003 Bransky et al.
D469,109 S 1/2003 Andre et al.
D472,245 S 3/2003 Andre et al.
6,546,231 B1 4/2003 Someya et al.
6,563,487 B2 5/2003 Martin et al.
6,587,091 B2 7/2003 Serpa
6,606,244 B1 8/2003 Liu et al.
6,618,909 B1 9/2003 Yang
6,636,197 B1 10/2003 Goldenberg et al.
6,639,584 B1 10/2003 Li
6,640,250 B1 10/2003 Chang et al.
6,650,975 B2 11/2003 Ruffner
D483,809 S 12/2003 Lim
6,658,773 B2 12/2003 Rohne et al.
6,664,951 B1 12/2003 Fujii et al.
6,677,927 B1 1/2004 Bruck et al.
6,678,891 B1 1/2004 Wilcox et al.
6,686,904 B1 2/2004 Sherman et al.
6,686,906 B2 2/2004 Salminen et al.
6,703,550 B2 3/2004 Chu
6,724,817 B1 4/2004 Simpson et al.
6,727,889 B2 4/2004 Shaw
D489,731 S 5/2004 Huang
6,738,045 B2 5/2004 Hinckley et al.
6,750,803 B2 6/2004 Yates et al.
6,781,576 B2 8/2004 Tamura
6,784,384 B2 8/2004 Park et al.
6,788,288 B2 9/2004 Ano
6,791,533 B2 9/2004 Su
6,795,057 B2 9/2004 Gordon
D497,618 S 10/2004 Andre et al.
6,810,271 B1 10/2004 Wood et al.
6,822,640 B2 11/2004 Derocher
6,834,975 B2 12/2004 Chu-Chia et al.
6,844,872 B1 1/2005 Farag et al.
6,855,899 B2 * 2/2005 Sotome ..... 200/317
6,865,718 B2 3/2005 Levi Montalcini
6,886,842 B2 5/2005 Vey et al.
6,894,916 B2 5/2005 Reohr et al.
D506,476 S 6/2005 Andre et al.
6,922,189 B2 7/2005 Fujiyoshi
6,930,494 B2 8/2005 Tesdahl et al.
6,958,614 B2 10/2005 Morimoto
6,977,808 B2 12/2005 Lam et al.
6,978,127 B1 12/2005 Bulthuis et al.
6,985,137 B2 1/2006 Kaikuranta
7,006,077 B1 2/2006 Uusimäki
7,019,225 B2 3/2006 Matsumoto et al.
7,046,230 B2 5/2006 Zadesky et al.
7,050,292 B2 * 5/2006 Shimura et al. ..... 361/679.01
7,069,044 B2 6/2006 Okada et al.
7,078,633 B2 7/2006 Ihalainen
7,084,856 B2 8/2006 Huppi
7,113,196 B2 9/2006 Kerr
7,117,136 B1 10/2006 Rosedale
7,119,792 B1 10/2006 Andre et al.
7,215,319 B2 5/2007 Kamijo et al.
7,233,318 B1 6/2007 Farag et al.
7,236,154 B1 6/2007 Kerr et al.
7,236,159 B1 6/2007 Siversson
7,253,643 B1 8/2007 Seguine
7,279,647 B2 10/2007 Philipp
7,288,732 B2 10/2007 Hashida
7,297,883 B2 11/2007 Rochon et al.
7,310,089 B2 12/2007 Baker et al.
7,312,785 B2 12/2007 Tsuk et al.
7,321,103 B2 * 1/2008 Nakanishi et al. ..... 200/512
7,333,092 B2 2/2008 Zadesky et al.
7,348,898 B2 3/2008 Ono
7,382,139 B2 6/2008 Mackey
7,394,038 B2 7/2008 Chang
7,395,081 B2 7/2008 Bonnelykke Kristensen et al.
7,397,467 B2 7/2008 Park et al.
7,439,963 B2 10/2008 Geaghan et al.
7,466,307 B2 12/2008 Trent et al.
7,479,949 B2 1/2009 Jobs et al.
7,486,323 B2 2/2009 Lee et al.
7,502,016 B2 3/2009 Trent, Jr. et al.
7,503,193 B2 3/2009 Schoene et al.

7,593,782 B2 9/2009 Jobs et al.
7,645,955 B2 1/2010 Huang et al.
7,671,837 B2 3/2010 Forsblad et al.
7,708,051 B2 5/2010 Katsumi et al.
7,772,507 B2 8/2010 Orr et al.
2001/0011991 A1 8/2001 Wang et al.
2001/0011993 A1 8/2001 Saarinen
2001/0033270 A1 10/2001 Osawa et al.
2001/0043545 A1 11/2001 Aratani
2001/0050673 A1 12/2001 Davenport
2001/0051046 A1 12/2001 Watanabe et al.
2002/0000978 A1 1/2002 Gerpheide
2002/0011993 A1 1/2002 Lui et al.
2002/0027547 A1 3/2002 Kamijo
2002/0030665 A1 3/2002 Ano
2002/0033848 A1 3/2002 Sciammarella et al.
2002/0039493 A1 4/2002 Tanaka
2002/0045960 A1 4/2002 Phillips et al.
2002/0071550 A1 6/2002 Pletikosa
2002/0089545 A1 7/2002 Levi Montalcini
2002/0103796 A1 8/2002 Hartley
2002/0118131 A1 8/2002 Yates et al.
2002/0118169 A1 8/2002 Hinckley et al.
2002/0145594 A1 10/2002 Derocher
2002/0154090 A1 10/2002 Lin
2002/0158844 A1 10/2002 McLoone et al.
2002/0164156 A1 11/2002 Bilbrey
2002/0168947 A1 11/2002 Lemley
2002/0180701 A1 12/2002 Hayama et al.
2002/0196239 A1 12/2002 Lee
2003/0002246 A1 1/2003 Kerr
2003/0025679 A1 2/2003 Taylor et al.
2003/0028346 A1 2/2003 Sinclair et al.
2003/0043121 A1 3/2003 Chen
2003/0043174 A1 3/2003 Hinckley et al.
2003/0050092 A1 3/2003 Yun
2003/0076301 A1 4/2003 Tsuk et al.
2003/0076303 A1 4/2003 Huppi
2003/0076306 A1 4/2003 Zadesky et al.
2003/0091377 A1 5/2003 Hsu et al.
2003/0095095 A1 5/2003 Pihlaja
2003/0095096 A1 5/2003 Robbin et al.
2003/0098851 A1 5/2003 Brink
2003/0103043 A1 6/2003 Mulligan et al.
2003/0122792 A1 7/2003 Yamamoto et al.
2003/0135292 A1 7/2003 Husgafvel et al.
2003/0142081 A1 7/2003 Iizuka et al.
2003/0184517 A1 10/2003 Senzui et al.
2003/0197740 A1 10/2003 Reponen
2003/0206202 A1 11/2003 Moriya
2003/0210537 A1 11/2003 Engelmann
2003/0224831 A1 12/2003 Engstrom et al.
2004/0027341 A1 2/2004 Derocher
2004/0074756 A1* 4/2004 Kawakami et al. ..... 200/600
2004/0080682 A1 4/2004 Dalton
2004/0109357 A1 6/2004 Cernea et al.
2004/0150619 A1 8/2004 Baudisch et al.
2004/0156192 A1 8/2004 Kerr et al.
2004/0178997 A1 9/2004 Gillespie et al.
2004/0200699 A1 10/2004 Matsumoto et al.
2004/0215986 A1 10/2004 Shakkarwar
2004/0224638 A1 11/2004 Fadell et al.
2004/0239622 A1 12/2004 Proctor et al.
2004/0252109 A1 12/2004 Trent, Jr. et al.
2004/0252867 A1 12/2004 Lan et al.
2004/0253989 A1 12/2004 Tupler et al.
2004/0263388 A1 12/2004 Krumm et al.
2004/0267874 A1 12/2004 Westberg et al.
2005/0012644 A1 1/2005 Hurst et al.
2005/0017957 A1 1/2005 Yi
2005/0024341 A1 2/2005 Gillespie et al.
2005/0030048 A1 2/2005 Bolender
2005/0052425 A1 3/2005 Zadesky et al.
2005/0052426 A1 3/2005 Hagermoser et al.
2005/0052429 A1 3/2005 Philipp
2005/0068304 A1 3/2005 Lewis et al.
2005/0083299 A1 4/2005 Nagasaka
2005/0083307 A1 4/2005 Aufderheide et al.
2005/0090288 A1 4/2005 Stohr et al.
2005/0104867 A1 5/2005 Westerman et al.
2005/0110768 A1 5/2005 Marriott et al.
2005/0129199 A1 6/2005 Abe
2005/0139460 A1* 6/2005 Hosaka ..... 200/314
2005/0140657 A1 6/2005 Park et al.
2005/0143124 A1 6/2005 Kennedy et al.
2005/0156881 A1 7/2005 Trent et al.
2005/0162402 A1 7/2005 Watanachote
2005/0204309 A1 9/2005 Szeto
2005/0237308 A1 10/2005 Autio et al.
2006/0026521 A1 2/2006 Hotelling et al.
2006/0032680 A1 2/2006 Elias et al.
2006/0038791 A1 2/2006 Mackey
2006/0095848 A1 5/2006 Naik
2006/0097991 A1 5/2006 Hotelling et al.
2006/0131156 A1 6/2006 Voelckers
2006/0143574 A1 6/2006 Ito et al.
2006/0174568 A1 8/2006 Kinoshita et al.
2006/0181517 A1 8/2006 Zadesky et al.
2006/0197750 A1 9/2006 Kerr et al.
2006/0232557 A1 10/2006 Fallot-Burghardt
2006/0236262 A1 10/2006 Bathiche et al.
2006/0250377 A1 11/2006 Zadesky et al.
2006/0274042 A1 12/2006 Krah et al.
2006/0274905 A1 12/2006 Lindahl et al.
2006/0279896 A1 12/2006 Bruwer
2006/0284836 A1 12/2006 Philipp
2007/0013671 A1 1/2007 Zadesky et al.
2007/0018970 A1 1/2007 Tabasso et al.
2007/0052044 A1 3/2007 Forsblad et al.
2007/0052691 A1 3/2007 Zadesky et al.
2007/0080936 A1 4/2007 Tsuk et al.
2007/0080938 A1 4/2007 Robbin et al.
2007/0080952 A1 4/2007 Lynch et al.
2007/0083822 A1 4/2007 Robbin et al.
2007/0085841 A1 4/2007 Tsuk et al.
2007/0097086 A1 5/2007 Battles et al.
2007/0120834 A1 5/2007 Boillot
2007/0126696 A1 6/2007 Boillot
2007/0152975 A1 7/2007 Ogihara et al.
2007/0152977 A1 7/2007 Ng et al.
2007/0152983 A1 7/2007 McKillop et al.
2007/0155434 A1 7/2007 Jobs et al.
2007/0157089 A1 7/2007 Van Os et al.
2007/0242057 A1 10/2007 Zadesky et al.
2007/0247421 A1 10/2007 Orsley et al.
2007/0247443 A1 10/2007 Philipp
2007/0271516 A1 11/2007 Carmichael
2007/0273671 A1 11/2007 Zadesky et al.
2007/0276525 A1 11/2007 Zadesky et al.
2007/0279394 A1 12/2007 Lampell
2007/0285404 A1 12/2007 Rimon et al.
2007/0290990 A1 12/2007 Robbin et al.
2007/0291016 A1 12/2007 Philipp
2007/0296709 A1 12/2007 GuangHai
2008/0006453 A1 1/2008 Hotelling et al.
2008/0006454 A1 1/2008 Hotelling
2008/0007533 A1 1/2008 Hotelling et al.
2008/0007539 A1 1/2008 Hotelling et al.
2008/0012837 A1 1/2008 Marriott et al.
2008/0018615 A1 1/2008 Zadesky et al.
2008/0018616 A1 1/2008 Lampell et al.
2008/0018617 A1 1/2008 Ng et al.
2008/0036473 A1 2/2008 Jansson
2008/0036734 A1 2/2008 Forsblad et al.
2008/0060925 A1 3/2008 Weber et al.
2008/0069412 A1 3/2008 Champagne et al.
2008/0079699 A1 4/2008 Mackey
2008/0087476 A1 4/2008 Prest
2008/0088582 A1 4/2008 Prest
2008/0088596 A1 4/2008 Prest
2008/0088597 A1 4/2008 Prest
2008/0088600 A1 4/2008 Prest
2008/0094352 A1 4/2008 Tsuk et al.
2008/0098330 A1 4/2008 Tsuk et al.
2008/0110739 A1 5/2008 Peng et al.
2008/0111795 A1 5/2008 Bollinger
2008/0143681 A1 6/2008 XiaoPing
2008/0165158 A1 7/2008 Hotelling et al.

| | | | |
|---|---|---|---|
| 2008/0196945 | A1 | 8/2008 | Konstas |
| 2008/0202824 | A1 | 8/2008 | Philipp et al. |
| 2008/0209442 | A1 | 8/2008 | Setlur et al. |
| 2008/0264767 | A1 | 10/2008 | Chen et al. |
| 2008/0280651 | A1 | 11/2008 | Duarte |
| 2008/0284742 | A1 | 11/2008 | Prest |
| 2008/0293274 | A1 | 11/2008 | Milan |
| 2009/0021267 | A1 | 1/2009 | Golovchenko et al. |
| 2009/0026558 | A1 | 1/2009 | Bauer et al. |
| 2009/0033635 | A1 | 2/2009 | Wai |
| 2009/0036176 | A1 | 2/2009 | Ure |
| 2009/0058687 | A1 | 3/2009 | Rothkopf et al. |
| 2009/0058801 | A1 | 3/2009 | Bull |
| 2009/0058802 | A1 | 3/2009 | Orsley et al. |
| 2009/0073130 | A1 | 3/2009 | Weber et al. |
| 2009/0078551 | A1 | 3/2009 | Kang |
| 2009/0109181 | A1 | 4/2009 | Hui et al. |
| 2009/0141046 | A1 | 6/2009 | Rathnam et al. |
| 2009/0160771 | A1 | 6/2009 | Hinckley et al. |
| 2009/0179854 | A1 | 7/2009 | Weber et al. |
| 2009/0197059 | A1 | 8/2009 | Weber et al. |
| 2009/0229892 | A1 | 9/2009 | Fisher et al. |
| 2009/0273573 | A1 | 11/2009 | Hotelling |
| 2010/0058251 | A1 | 3/2010 | Rottler et al. |
| 2010/0060568 | A1 | 3/2010 | Fisher et al. |
| 2010/0073319 | A1 | 3/2010 | Lyon et al. |
| 2010/0149127 | A1 | 6/2010 | Fisher et al. |
| 2010/0289759 | A1 | 11/2010 | Fisher et al. |
| 2011/0005845 | A1 | 1/2011 | Hotelling et al. |

FOREIGN PATENT DOCUMENTS

| | | | |
|---|---|---|---|
| CN | 1455615 | | 11/2003 |
| CN | 1499356 | | 5/2004 |
| CN | 1659506 | | 8/2005 |
| DE | 3615742 | | 11/1987 |
| DE | 19722636 | | 12/1998 |
| DE | 10022537 | | 11/2000 |
| DE | 20019074 | U1 | 2/2001 |
| DE | 10 2004 043 663 | | 4/2006 |
| EP | 0178157 | | 4/1986 |
| EP | 0419145 | A1 | 3/1991 |
| EP | 0 498 540 | | 8/1992 |
| EP | 0 521 683 | | 1/1993 |
| EP | 0 674 288 | | 9/1995 |
| EP | 0 731 407 | | 9/1996 |
| EP | 0 551 778 | B1 | 1/1997 |
| EP | 0 880 091 | A2 | 11/1998 |
| EP | 1 026 713 | | 8/2000 |
| EP | 1 081 922 | A2 | 3/2001 |
| EP | 1 098 241 | A2 | 5/2001 |
| EP | 1 133 057 | | 9/2001 |
| EP | 1 162 826 | A2 | 12/2001 |
| EP | 1 168 396 | | 1/2002 |
| EP | 1 205 836 | A2 | 5/2002 |
| EP | 1 244 053 | | 9/2002 |
| EP | 1 251 455 | A2 | 10/2002 |
| EP | 1263193 | | 12/2002 |
| EP | 1347481 | | 9/2003 |
| EP | 1376326 | | 1/2004 |
| EP | 1 467 392 | | 10/2004 |
| EP | 1 482 401 | | 12/2004 |
| EP | 1 496 467 | | 1/2005 |
| EP | 1 517 228 | | 3/2005 |
| EP | 1 542 437 | A2 | 6/2005 |
| EP | 1 589 407 | | 10/2005 |
| EP | 1 784 058 | | 5/2007 |
| EP | 1 841 188 | | 10/2007 |
| EP | 1850218 | | 10/2007 |
| EP | 1 876 711 | | 1/2008 |
| FR | 2 686 440 | | 7/1993 |
| GB | 2015167 | | 9/1979 |
| GB | 2072389 | | 9/1981 |
| GB | 2315186 | | 1/1998 |
| GB | 2333215 | | 7/1999 |
| GB | 2391060 | | 1/2004 |
| GB | 2 402 105 | | 12/2004 |
| JP | 57-95722 | | 6/1982 |
| JP | 57-97626 | | 6/1982 |
| JP | 61-117619 | | 6/1986 |
| JP | 61-124009 | | 6/1986 |
| JP | 63-20411 | | 1/1988 |
| JP | 63-106826 | | 5/1988 |
| JP | 63-181022 | | 7/1988 |
| JP | 63-298518 | | 12/1988 |
| JP | 03-57617 | | 6/1991 |
| JP | 3-192418 | | 8/1991 |
| JP | 04-32920 | | 2/1992 |
| JP | 4-205408 | | 7/1992 |
| JP | 5-041135 | | 2/1993 |
| JP | 5-080938 | | 4/1993 |
| JP | 5-101741 | | 4/1993 |
| JP | 5-36623 | | 5/1993 |
| JP | 5-189110 | | 7/1993 |
| JP | 5-205565 | | 8/1993 |
| JP | 5-211021 | | 8/1993 |
| JP | 5-217464 | | 8/1993 |
| JP | 5-233141 | | 9/1993 |
| JP | 5-262276 | | 10/1993 |
| JP | 5-265656 | | 10/1993 |
| JP | 5-274956 | | 10/1993 |
| JP | 5-289811 | | 11/1993 |
| JP | 5-298955 | | 11/1993 |
| JP | 5-325723 | | 12/1993 |
| JP | 6-20570 | | 1/1994 |
| JP | 6-084428 | | 3/1994 |
| JP | 6-089636 | | 3/1994 |
| JP | 6-96639 | | 4/1994 |
| JP | 6-111695 | | 4/1994 |
| JP | 6-139879 | | 5/1994 |
| JP | 6-187078 | | 7/1994 |
| JP | 6-208433 | | 7/1994 |
| JP | 6-267382 | | 9/1994 |
| JP | 6-283993 | | 10/1994 |
| JP | 6-333459 | | 12/1994 |
| JP | 7-107574 | | 4/1995 |
| JP | 7-41882 | | 7/1995 |
| JP | 7-201249 | | 8/1995 |
| JP | 7-201256 | | 8/1995 |
| JP | 7-253838 | | 10/1995 |
| JP | 7-261899 | | 10/1995 |
| JP | 7-261922 | | 10/1995 |
| JP | 7-296670 | | 11/1995 |
| JP | 7-319001 | | 12/1995 |
| JP | 8-016292 | | 1/1996 |
| JP | 8-115158 | | 5/1996 |
| JP | 8-203387 | | 8/1996 |
| JP | 8-293226 | | 11/1996 |
| JP | 8-298045 | | 11/1996 |
| JP | 8-299541 | | 11/1996 |
| JP | 8-316664 | | 11/1996 |
| JP | 9-044289 | | 2/1997 |
| JP | 9-069023 | | 3/1997 |
| JP | 9-128148 | | 5/1997 |
| JP | 9-134248 | | 5/1997 |
| JP | 9-218747 | | 8/1997 |
| JP | 9-230993 | | 9/1997 |
| JP | 9-231858 | | 9/1997 |
| JP | 9-233161 | | 9/1997 |
| JP | 9-251347 | | 9/1997 |
| JP | 9-258895 | | 10/1997 |
| JP | 9-288926 | | 11/1997 |
| JP | 9-512979 | | 12/1997 |
| JP | 10-63467 | | 3/1998 |
| JP | 10-74127 | | 3/1998 |
| JP | 10-074429 | | 3/1998 |
| JP | 10-198507 | | 7/1998 |
| JP | 10-227878 | | 8/1998 |
| JP | 10-240693 | | 9/1998 |
| JP | 10-320322 | | 12/1998 |
| JP | 10-326149 | | 12/1998 |
| JP | 11-24834 | | 1/1999 |
| JP | 11-184607 | | 7/1999 |
| JP | 11-194863 | | 7/1999 |
| JP | 11-194872 | | 7/1999 |
| JP | 11-194882 | | 7/1999 |
| JP | 11-194883 | | 7/1999 |
| JP | 11-194891 | | 7/1999 |
| JP | 11-195353 | | 7/1999 |

| | | | |
|---|---|---|---|
| JP | 11-203045 | | 7/1999 |
| JP | 11-212725 | | 8/1999 |
| JP | 11-272378 | | 10/1999 |
| JP | 11-338628 | | 12/1999 |
| JP | 2000-200147 | | 7/2000 |
| JP | 2000-215549 | | 8/2000 |
| JP | 2000-267777 | | 9/2000 |
| JP | 2000-267786 | | 9/2000 |
| JP | 2000-267797 | | 9/2000 |
| JP | 2000-353045 | | 12/2000 |
| JP | 2001-11769 | | 1/2001 |
| JP | 2001-22508 | | 1/2001 |
| JP | 2001-184158 | | 7/2001 |
| JP | 3085481 | | 2/2002 |
| JP | 2002-215311 | | 8/2002 |
| JP | 2003-015796 | | 1/2003 |
| JP | 2003-060754 | | 2/2003 |
| JP | 2003-099198 | | 4/2003 |
| JP | 2003-150303 | | 5/2003 |
| JP | 2003-517674 | | 5/2003 |
| JP | 2003-280799 | | 10/2003 |
| JP | 2003-280807 | | 10/2003 |
| JP | 2004-362097 | | 12/2004 |
| JP | 2005-251218 | | 9/2005 |
| JP | 2005-285140 | | 10/2005 |
| JP | 2005-293606 | | 10/2005 |
| JP | 2006-004453 | | 1/2006 |
| JP | 2006-178962 | | 7/2006 |
| JP | 3852854 | | 12/2006 |
| JP | 2007-123473 | | 5/2007 |
| KR | 1998-71394 | | 10/1998 |
| KR | 1999-50198 | | 7/1999 |
| KR | 2000-0008579 | | 2/2000 |
| KR | 2001-0052016 | | 6/2001 |
| KR | 2001-108361 | | 12/2001 |
| KR | 2002-65059 | | 8/2002 |
| KR | 10-2006-0021678 | | 3/2006 |
| TW | 431607 | | 4/2001 |
| TW | 00470193 | | 12/2001 |
| TW | 547716 | | 8/2003 |
| TW | 1220491 | | 8/2004 |
| WO | WO-94/17494 | | 8/1994 |
| WO | WO-95/00897 | A1 | 1/1995 |
| WO | WO-96/27968 | | 9/1996 |
| WO | WO 98/14863 | | 4/1998 |
| WO | WO-99/49443 | | 9/1999 |
| WO | WO-00/79772 | | 12/2000 |
| WO | WO-01/02949 | | 1/2001 |
| WO | WO-01/44912 | | 6/2001 |
| WO | WO-02/08881 | | 1/2002 |
| WO | WO-03/025960 | | 3/2003 |
| WO | WO-03/044645 | | 5/2003 |
| WO | WO-03/044956 | | 5/2003 |
| WO | WO-03/088176 | | 10/2003 |
| WO | WO-03/090008 | | 10/2003 |
| WO | WO-04/001573 | | 12/2003 |
| WO | WO-2004/040606 | | 5/2004 |
| WO | WO-2004/091956 | | 10/2004 |
| WO | WO-2005/055620 | | 6/2005 |
| WO | WO-2005/076117 | | 8/2005 |
| WO | WO-2005/114369 | | 12/2005 |
| WO | WO-2005/124526 | | 12/2005 |
| WO | WO-2006/020305 | | 2/2006 |
| WO | WO-2006/021211 | A2 | 3/2006 |
| WO | WO-2006/037545 | | 4/2006 |
| WO | WO 2006/104745 | | 10/2006 |
| WO | WO-2006/135127 | | 12/2006 |
| WO | WO-2007/025858 | | 3/2007 |
| WO | WO-2007/078477 | | 7/2007 |
| WO | WO-2007/084467 | | 7/2007 |
| WO | WO-2007/089766 | | 8/2007 |
| WO | WO-2008/007372 | | 1/2008 |
| WO | WO-2008/045414 | | 4/2008 |
| WO | WO-2008/045833 | | 4/2008 |

OTHER PUBLICATIONS

Zadesky et al., U.S. Office Action mailed Nov. 16, 2010, directed to U.S. Appl. No. 11/477,469; 13 pages.
Lampell, U.S. Office Action mailed Dec. 3, 2010, directed to U.S. Appl. No. 11/530,807; 17 pages.
Lampell et al., U.S. Office Action mailed Dec. 22, 2010, directed to U.S. Appl. No. 11/882,427; 16 pages.
Hotelling, U.S. Office Action mailed Dec. 8, 2010, directed to U.S. Appl. No. 11/482,286; 33 pages.
Elias et al., U.S. Office Action mailed Nov. 22, 2010, directed to U.S. Appl. No. 11/203,692; 6 pages.
"About Quicktip®" www.logicad3d.com/docs/qt.html, downloaded Apr. 8, 2002.
"Alps Electric introduces the GlidePoint Wave Keyboard; combines a gently curved design with Alps' advanced GlidePoint Technology," Business Wire (Oct. 21, 1996).
"Alps Electric Ships GlidePoint Keyboard for the Macintosh; Includes a GlidePoint Touchpad, Erase-Eaze Backspace Key and Contoured Wrist Rest," Business Wire (Jul. 1, 1996).
"Apple Presents iPod: Ultra-Portable MP3 Music Player Puts 1,000 Songs in Your Pocket," retreived from http://www.apple.com/pr/library/2001/oct/23ipod.html on Oct. 23, 2001.
"Apple Unveils Optical Mouse and New Pro Keyboard," Press Release, Jul. 19, 2000.
"APS show guide to exhibitors," Physics Today 49(3) (Mar. 1996).
"Atari VCS/2600 Peripherals," www.classicgaming.com/gamingmuseum/2006p.html, downloaded Feb. 28, 2007, pp. 1-15.
Ahl, David, "Controller Update," Creative Computing Vo. 9, No. 12, Dec. 1983.
Ahmad, "A Usable Real-Time 3D Hand Tracker," Proceedings of the 28th Asilomar Conference on Signals, Systems and Computers—Part 2 (of 2) vol. 2 (Oct. 1994).
Baig, E.C., "Your PC Just Might Need a Mouse," U.S. News & World Report 108(22) (Jun. 4, 1990).
Bang & Olufsen Telecom a/s. (2000). BeoCom 6000 User Guide; 53 pages.
Bartimo, Jim, "The Portables: Travelling Quickly," Computerworld (Nov. 14, 1983).
Boling, Douglas (1993) "Programming Microsoft Windows CE.NET," p. 109.
Bray, "Phosphors help switch on xenon," Physics in Action, pp. 1-3, Apr. 1999.
Brink et al., "Pumped-up portables," U.S. News & World Report 116(21) (May 30, 1994).
Brown et al., "Windows on Tablets as a Means of Achieving Virtual Input Devices," Human-Computer Interaction—Interact '90 (1990).
Buxton et al., "Issues and Techniques in Touch-Sensitive Tablet Input," Computer Graphics 19(3), Proceedings of SIGGRAPH '85 (1985).
Chapweske, Adam "PS/2 Mouse/Keyboard Protocol," 1999, http://panda.cs.ndsu.nodak.edu/~achapwes/PICmicro/PS2/ps2.htm.
Chen et al., "A Study in Interactive 3-D Rotation Using 2-D Control Devices," Computer Graphics 22(4) (Aug. 1988).
De Meyer, Kevin, "Crystal Optical Mouse," Feb. 14, 2002, Heatseekerz, Web Article 19.
"Der Klangmeister," Connect Magazine, Aug. 1998.
"Design News literature plus," Design News 51(24) (Dec. 18, 1995).
"Diamond Multimedia Announces Rio PMP300 Portable MP3 Music Player," located at http://news.harmony-central.com/Newp/1998/Rio-PMP300.html visited on May 5, 2008. (4 pages).
Evans et al., "Tablet-based Valuators that Provide One, Two, or Three Degrees of Freedom," Computer Grahics 15(3) (Aug. 1981).
EVB Elektronik "TSOP6238 IR Receiver Modules for Infrared Remote Control Systems" dated Jan. 2004 1 page.
Fiore, "Zen Touchpad," Cornell University, May 2000.
Gadgetboy, "Point and click with the latest mice," CNET Asia Product Review, www.asia.cnet.com/reviews...are/gadgetboy/0,39001770,380235900,00.htm, downloaded Dec. 5, 2001.
Gfroerer, "Photoluminescence in Analysis of Surfaces and Interfaces," Encyclopedia of Analyical Chemistry, pp. 1-23, Copyright John Wiley & Sons Ltd, Chichester, 2000.
Interlink Electronics, VersaPad: Integration Guide, © 1998 (VersaPad), pp. 1-35.
Jesitus, John, "Broken promies?", Industry Week/IW 246(20) (Nov. 3, 1997).

Kobayashi (1996) "Design of Dynamic Soundscape: Mapping Time to Space for Audio Browsing with Simultaneous Listening," Thesis submitted to Program in Media Arts and Sciences at the Massachusetts Institute of Technology, (58 pages.)
Kobayashi et al. (1994) "Development of the Touch Switches with the Click Response," Koukuu Denshi Gihou No. 17, pp. 44-48 (published by the Japan Aviation Electronics Industry, Ltd.).
Kobayashi et al. (1997) "Dynamic Soundscape: Mapping Time to Space for Audio Browsing," Computer Human Interaction: 16 pages.
Letter re: Bang & Olufsen a/s by David Safran, Nixon Peabody, LLP, May 21, 2004, with BeoCom 6000 Sales Training Brochure, 7 pages.
Luna Technologies International, Inc., LUNA Photoluminescent Safety Products, "Photoluminescence—What is Photoluminescence?" from website at http://www.lunaplast.com/photoluminescence.com on Dec. 27, 2005.
MIMS, Forrest M., III, "A Few Quick Pointers; Mouses, Touch Screens, Touch Pads, Light Pads, and The Like Can Make System Easier to Use," Computers & Electronics (22) (May 1984).
"Manufactures," Laser Focus World, Buyers Guide '96, 31(12) (Dec. 1995).
Nass, Richard, "Touchpad input device goes digital to give portable systems a desktop 'mouse-like' feel," Electronic Design 44(18) (Sep. 3, 1996).
"National Design Engineering Show,"Design News 52(5) (Mar. 4, 1996).
"Neuros MP3 Digital Audio Computer," www.neurosaudio.com, downloaded Apr. 9, 2003.
"OEM Touchpad Modules" website www.glidepoint.com/sales/modules.index.shtml, downloaded Feb. 13, 2002.
"Preview of exhibitor booths at the Philadelphia show," Air Conditioning, Heating & News 200(2) (Jan. 13, 1997).
"Product news," Design News 53(11) (Jun. 9, 1997).
"Product news," Design News 53(9) (May 5, 1997).
"Product Overview—ErgoCommander®," www.logicad3d.com/products/ErgoCommander.htm, downloaded Apr. 8, 2002.
"Product Overview—SpaceMouse® Classic," www.logicad3d.com/products/Classic.htm, downloaded Apr. 8, 2002.
Perenson, Melissa, "New & Improved: Touchpad Redux," PC Magazine (Sep. 10, 1996).
Petersen, Marty, "Koala Pad Touch Tablet & Micro Illustrator Software," InfoWorld (Oct. 10, 1983).
Petruzzellis, "Force-Sensing Resistors," Electronics Now 64(3) (Mar. 1993).
Photographs of Innovation 2000 Best of Show Award Presented at the 2000 Int'l CES Innovations Design & Engineering Shcwcase, Jan. 6, 2000, 1 page.
SanDisk Sansa Connect User Guide, 2007; 29 pages.
Soderholm, Lars G., "Sensing Systems for 'Touch and Feel,'" Design News (May 8, 1989): pp. 72-76.
Sony presents "Choice Without Compromise" at IBC '97 M2 Presswire (Jul. 24, 1997).
Spiwak, Marc, "A Great New Wireless Keyboard," Popular Electronics 14(12) (Dec. 1997).
Spiwak, Marc, "A Pair of Unusual Controllers," Popular Electronics 14(4) (Apr. 1997).
Sylvania, "Intellvision™ Intelligent Television Master Component Service Manual," pp. 1, 2 and 8, 1979.
"Synaptics Tough Pad Interfacing Guide," Second Edition, Mar. 25, 1998, Synaptics, Inc., San Jose, CA, pp. 1-90.
"System Service and Troubleshooting Manual," www.dsplib.com/intv/Master, downloaded Dec. 11, 2002.
Tessler, Franklin, "Point Pad," Macworld 12(10) (Oct. 1995).
Tessler, Franklin, "Smart Input: How to Chose from the New Generation of Innovative Input Devices," Macworld 13(5) (May 1996).
Tessler, Franklin, "Touchpads," Macworld 13(2) (Feb. 1996).
Translation of Trekstor's Defense Statement to the District Court Mannheim of May 23, 2008; 37 pages.
"Triax Custom Controllers due; Video Game Controllers," HFD—The Weekly Home Furnishing Newspaper 67(1) (Jan. 4, 1993).
"Touchpad," Notebook PC Manual, ACER Information Co. Ltd., Feb. 16, 2005, pp. 11-12.
Tsuk et al., U.S. Office Action mailed Sep. 30, 2004, directed to U.S. Appl. No. 10/256,716; 11 pages.
Tsuk et al., U.S. Office Action mailed Jun. 24, 2005, directed to U.S. Appl. No. 10/256,716; 12 pages.
Tsuk et al., U.S. Office Action mailed Jan. 10, 2006, directed to U.S. Appl. No. 10/256,716; 12 pages.
Tsuk et al., U.S. Office Action mailed Aug. 3, 2006, directed to U.S. Appl. No. 10/256,716; 15 pages.
Tsuk et al., U.S. Office Action mailed Oct. 13, 2006, directed to U.S. Appl. No. 10/256,716; 16 pages.
Tsuk et al., U.S. Office Action mailed Aug. 7, 2009, directed to U.S. Appl. No. 11/610,181; 20 pages.
Tsuk et al., U.S. Office Action mailed Jul. 7, 2009, directed to U.S. Appl. No. 11/610,190; 24 pages.
Tsuk et al., U.S. Office Action mailed Dec. 31, 2009, directed to U.S. Appl. No. 11/610,190; 25 pages.
Tsuk et al., U.S. Office Action mailed Apr. 28, 2010, directed to U.S. Appl. No. 11/610,190; 29 pages.
Robbin et al., U.S. Office Action mailed Sep. 30, 2004, directed to U.S. Appl. No. 10/259,159; 14 pages.
Robbin et al., U.S. Office Action mailed Jun. 16, 2005, directed to U.S. Appl. No. 10/259,159; 16 pages.
Robbin et al., U.S. Office Action mailed Jan. 11, 2006, directed to U.S. Appl. No. 10/259,159; 15 pages.
Robbin et al., U.S. Office Action mailed Aug. 3, 2006, directed to U.S. Appl. No. 10/259,159; 15 pages.
Robbin et al., U.S. Office Action mailed Oct. 13, 2006, directed to U.S. Appl. No. 10/259,159; 18 pages.
Robbin et al., U.S. Office Action mailed Jan. 18, 2007, directed to U.S. Appl. No. 10/259,159; 18 pages.
Robbin et al., U.S. Office Actioh mailed Aug. 10, 2009, directed to U.S. Appl. No. 11/610,376; 11 pages.
Robbin et al., U.S. Office Action mailed Aug. 12, 2009, directed to U.S. Appl. No. 11/610,384; 20 pages.
Zadesky et al., U.S. Office Action mailed Oct. 27, 2006, directed to U.S. Appl. No. 10/643,256; 14 pages.
Zadesky et al., U.S. Office Action mailed Mar. 23, 2007, directed to U.S. Appl. No. 10/643,256; 11 pages.
Zadesky et al., U.S. Office Action mailed Jul. 13, 2007, directed to U.S. Appl. No. 10/643,256; 13 pages.
Zadesky et al., U.S. Office Action mailed Dec. 12, 2007, directed to U.S. Appl. No. 10/643,256; 12 pages.
Zadesky et al., U.S. Office Action mailed Jul. 9, 2008, directed to U.S. Appl. No. 10/643,256; 12 pages.
Zadesky et al., U.S. Office Action mailed Mar. 30, 2010, directed to U.S. Appl. No. 11/592,679; 13 pages.
Ng et al., U.S. Office Action mailed Jan. 14, 2010, directed to U.S. Appl. No. 11/394,493; 20 pages.
Ng et al., U.S. Office Action mailed Jan. 15, 2010, directed to U.S. Appl. No. 11/882,423; 22 pages.
Forsblad et al., U.S. Office Action mailed Jan. 26, 2009, directed to U.S. Appl. No. 11/355,022; 15 pages.
Forsblad et al., U.S. Office Action mailed Jun. 25, 2009, directed to U.S. Appl. No. 11/355,022; 18 pages.
Forsblad et al., U.S. Office Action mailed Jan. 27, 2009, directed to U.S. Appl. No. 11/882,421; 15 pages.
Lampell, U.S. Office Action mailed Sep. 15, 2009, directed to U.S. Appl. No. 11/530,807; 15 pages.
Zadesky et al., U.S. Office Action mailed Nov. 20, 2007, directed to U.S. Appl. No. 11/057,050; 33 pages.
Zadesky et al, U.S. Office Action mailed Aug. 19, 2008, directed to U.S. Appl. No. 11/057,050; 23 pages.
Zadesky et al., U.S. Office Action mailed Nov. 26, 2008, directed to U.S. Appl. No. 11/057,050; 25 pages.
Zadesky et al., U.S. Office Action mailed Dec. 24, 2008, directed to U.S. Appl. No. 11/057,050; 25 pages.
Zadesky et al., U.S. Office Action mailed Feb. 20, 2009, directed to U.S. No. 11/057,050; 25 pages.
Zadesky et al., U.S. Office Action mailed Aug. 6, 2009, directed to U.S. No. 11/057,050; 30 pages.
Zadesky et al., U.S. Office Action mailed Mar. 5, 2009, directed to U.S. Appl. No. 11/477,469; 12 pages.
Zadesky et al., U.S. Office Action mailed Feb. 4, 2010, directed to U.S. Appl. No. 11/477,469; 14 pages.

Zadesky et al., U.S. Office Action mailed Mar. 4, 2004, directed to U.S. Appl. No. 10/188,182; 8 pages.
Zadesky et al., U.S. Office Action mailed Jul. 30, 2004, directed to U.S. Appl. No. 10/188,182; 7 pages.
Zadesky et al., U.S. Office Action mailed Sep. 21, 2005, directed to U.S. Appl. No. 10/188,182; 10 pages.
Zadesky et al., U.S. Office Action mailed Oct. 4, 2007, directed to U.S. Appl. No. 11/386,238; 12 pages.
Zadesky et al.., U.S. Office Action mailed Oct. 4, 2007, directed to U.S. Appl. No. 11/806,957; 14 pages.
Marriott et al., U.S. Office Action mailed Jun. 2, 2006, directed to U.S. Appl. No. 10/722,948; 12 pages.
Marriott et al., U.S. Office Action mailed Dec. 12, 2006, directed to U.S. Appl. No. 10/722,948; 14 pages.
Marriott et al., U.S. Office Action mailed Jul. 13, 2007, directed to U.S. Appl. No. 10/722,948; 15 pages.
Marriott et al., U.S. Office Action mailed Jan. 30, 2008, directed to U.S. Appl. No. 10/722,948; 17 pages.
Hotelling, U.S. Office Action mailed Jan. 25, 2010, directed to U.S. Appl. No. 11/482,286; 17 pages.
Hotelling, U.S. Office Action mailed Sep. 1, 2009, directed to U.S. Appl. No. 11/482,286; 14 pages.
Hotelling et al., U.S. Office Action mailed Jul. 24, 2009, directed to U.S. Appl. No. 11/483,008; 17 pages.
Hotelling et al., U.S. Office Action mailed Mar. 30, 2010, directed to U.S. Appl. No. 11/483,008; 20 pages.
Hotelling et al., U.S. Office Action mailed Jul. 27, 2009, directed to U.S. Appl. No. 11/882,420; 17 pages.
Elias et al., U.S. Office Action mailed Sep. 17, 2008, directed to U.S. Appl. No. 11/203,692; 8 pages.
Elias et al., U.S. Office Action mailed Feb. 23, 2009, directed to U.S. Appl. No. 11/203,692; 13 pages.
Elias et al., U.S. Office Action mailed Aug. 4, 2009, directed to U.S. Appl. No. 11/203,692; 12 pages.
Elias et al., U.S. Office Action mailed Mar. 30, 2010, directed to U.S. Appl. No. 11/203,692; 15 pages.
Lynch et al., U.S. Office Action mailed Jan. 27, 2010, directed to U.S. Appl. No. 11/499,360; 8 pages.
Lynch et al., U.S. Office Action mailed Oct. 5, 2009, directed to U.S. Appl. No. 11/499,360; 7 pages.
Bollinger, U.S. Appl. No. 60/858,404, filed Nov. 13, 2006, entitled "Method of Capacitively Sensing Finger Position"; 13 pages.
Elias et al., U.S. Appl. No. 60/522,107, filed Aug. 16, 2004, entitled, "A Method for Increasing the Spatial Resolution of Touch Sensitive Devices"; 15 pages.
Fisher et al., U.S. Appl. No. 61/036,804, filed Mar. 14, 2008 entitled "Switchable Sensor Configurations"; 46 pages.
Grignon et al., U.S. Appl. No. 60/755,656, filed Dec. 30, 2005, entitled "Touch Pad with Feedback"; 109 pages.
Hotelling, U.S. Appl. No. 60/658,777 titled "Multi-Functional Hand-held Device," filed Mar. 4, 2005; 68 pages.
Lampell et al., U.S. Appl. No. 60/810,423, filed Jun. 2, 2006, entitled "Techniques for Interactive Input to Portable Electronic Devices"; 53 pages.
Prest et al., U.S. Appl. No. 60/850,662, filed Oct. 11, 2006, entitled, "Capacitive Scroll Wheel"; 21 pages.
Rathnam et al., U.S. Appl. No. 60/992,056, filed Dec. 3, 2007, entitled, "Scroll Wheel Circuit Arrangements and Methods of Use Thereof"; 42 pages.
Rathnam et al., U.S. Appl. No. 61/017,436, filed Dec. 28, 2007, entitled, "Multi-Touch Scroll Wheel Circuit Arrangements and Processing Methods"; 58 pages.
Robbin et al., U.S. Appl. No. 60/387,692, entitled "Method and Apparatus for Use of Rotational User Inputs," filed Jun. 10, 2002.
Robbin et al., U.S. Appl. No. 60/399,806 entitled "Graphical User Interface and Methods of Use Thereof in a Multimedia Player," filed Jul. 30, 2002.
Robbin, U.S. Appl. No. 60/346,237 entitled, "Method and System for List Scrolling," filed Oct. 22, 2001; 12 pages.
Rothkopf, U.S. Appl. No. 60/935,854 titled "Compact Media Players," filed Sep. 4, 2007; 36 pages.
Weber et al., U.S. Appl. No. 61/020,531, filed Jan. 11, 2008 entitled "Modifiable Clickwheel Text"; 11 pages.
Weber et al., U.S. Appl. No. 61/025,531, filed Feb. 1, 2008 entitled "Co-Extruded Materials and Methods"; 11 pages.
Zadesky et al., U.S. Appl. No. 60/359,551, entitled "Touchpad for Handheld Device," filed Feb. 25, 2002; 34 pages.
Zadesky et al., U.S. Appl. No. 60/714,609 entitled "Scrolling Input Arrangements Using Capacitive Sensors on a Flexible Membrane," filed Sep. 6, 2005; 17 pages.
Chinese Office Action issue Dec. 29, 2006, directed to CN Application No. 200510103886.3, 25 pages.
Ng et al., U.S. Office Action mailed Jun. 22, 2010, directed to U.S. Appl. No. 11/394,493; 14 pages.
Lampell, U.S. Office Action mailed Jun. 4, 2010, directed to U.S. Appl. No. 11/530,807; 15 pages.
Prest et al., U.S. Office Action mailed Jun. 22, 2010, directed to U.S. Appl. No. 11/878,132; 32 pages.
Prest et al., U.S. Office Action mailed Jun. 22, 2010, directed to U.S. Appl. No. 11/882,882; 32 pages.
Prest et al., U.S. Office Action mailed Jun. 23, 2010, directed to U.S. Appl. No. 11/812,384; 29 pages.
Prest et al., U.S. Office Action mailed Jun. 22, 2010, directed to U.S. Appl. No. 11/882,890; 15 pages.
Prest et al., U.S. Office Action mailed Jun. 22, 2010, directed to U.S. Appl. No. 11/812,383; 21 pages.
Prest et al., U.S. Office Action mailed Jun. 23, 2010, directed to U.S. Appl. No. 11/882,889; 13 pages.
Bollinger et al., U.S. Office Action mailed Jun. 25, 2010, directed to U.S. Appl. No. 11/842,724; 22 pages.
Hotelling, U.S. Office Action mailed Jun. 9, 2010, directed to U.S. Appl. No. 11/482,286; 21 pages.
Elias et al., U.S. Office Action mailed Jun. 11, 2010, directed to U.S. Appl. No. 11/203,692; 17 pages.
Weber et al., U.S. Office Action mailed Jun. 7, 2010, directed to U.S. Appl. No. 11/856,530; 15 pages.
Ng et al., U.S. Office Action mailed Jul. 8, 2010, directed to U.S. Appl. No. 11/882,423; 19 pages.
Tsuk et al., U.S. Office Action mailed Aug. 6, 2010, directed to U.S. Appl. No. 11/610,190; 30 pages.
Zadesky et al., U.S. Office Action mailed Aug. 2, 2010, directed to U.S. Appl. No. 11/882,004; 9 pages.
Marriott et al., U.S. Office Action mailed Aug. 19, 2010, directed to U.S. Appl. No. 11/882,422; 13 pages.
Hotelling, U.S. Office Action mailed Aug. 18, 2010, directed to U.S.Appl. No. 11/882,424; 16 pages.
Bull, U.S. Office Action mailed Jul. 9, 2010, directed to U.S. Appl. No. 11/849,801; 13 pages.
Tsuk et al., U.S. Office Action mailed Nov. 1, 2010, directed to U.S. Appl. No. 11/959,918; 9 pages.
Tsuk et al., U.S. Office Action mailed Oct. 26, 2010, directed to U.S. Appl. No. 11/959,942; 27 pages.
Robbin et al., U.S. Office Action mailed Oct. 29, 2010, directed to U.S. Appl. No. 11/838,845; 8 pages.
Ng et al., U.S. Office Action mailed Oct. 26, 2010, directed to U.S. Appl. No. 11/882,423; 18 pages.
Zadesky et al., U.S. Office Action mailed Oct. 4, 2010, directed to U.S. Appl. No. 11/057,050; 31 pages.
McKillop et al., U.S. Office Action mailed Sep. 16, 2010, directed to U.S. Appl. No. 11/591,752; 14 pages.
Zadesky et al., U.S. Office Action mailed Sep. 29, 2010, directed to U.S. Appl. No. 11/882,003; 13 pages.
Hotelling, U.S. Office Action mailed Oct. 1, 2010, directed to U.S. Appl. No. 11/482,286; 28 pages.
Hotelling et al., U.S. Office Action mailed Oct. 27, 2010, directed to U.S. Appl. No. 11/483,008; 23 pages.
Weber et al., U.S. Office Action mailed Oct. 13, 2010, directed to U.S. Appl. No. 12/205,795; 15 pages.
Zadesky et al, U.S. Office Action mailed Feb. 1, 2011, directed to U.S. Appl. No. 11/882,004; 16 pages.
Bull, U.S. Office Action mailed Feb. 4, 2011, directed to U.S. Appl. No. 11/849,801; 22 pages.
Weber et al, U.S. Office Action mailed Jan. 7, 2011, directed to U.S. Appl. No. 11/856,530; 13 pages.

Weber et al., U.S. Office Action mailed Jan. 7, 2011, directed to U.S. Appl. No. 12/205,795; 21 pages.
Tsuk et al., U.S. Office Action mailed Apr. 19, 2011, directed to U.S. Appl. No. 11/610,190; 25 pages.
Tsuk et al., U.S. Office Action mailed Mar. 31, 2011, directed to U.S. Appl. No. 11/959,918; 9 pages.
Robbin et al., U.S. Office Action mailed Apr. 26, 2011, directed to U.S. Appl. No. 11/838,845; 9 pages.
Zadesky et al., U.S. Office Action mailed Mar. 31, 2011, directed to U.S. Appl. No. 11/882,005; 7 pages.
Bollinger et al., U.S. Office Action mailed Mar. 21, 2011, directed to U.S. Appl. No. 11/842,724; 22 pages.
McKillop et al., U.S. Office Action mailed Mar. 24, 2011, directed to U.S. Appl. No. 11/591,752; 11 pages.
Zadesky et al., U.S. Office Action mailed Mar. 16, 2011, directed to U.S. Appl. No. 11/882,003; 12 pages.
Rathnam et al., U.S. Office Action mailed Mar. 24, 2011, directed to U.S. Appl. No. 12/205,757; 14 pages.

* cited by examiner

HYBRID BUTTON

REFERENCE TO RELATED APPLICATIONS

This application is a divisional of U.S. patent application Ser. No. 11/519,259 filed on Sep. 11, 2006, now allowed.

BACKGROUND OF THE INVENTION

This invention can relate to buttons with improved strength and durability. More particularly, this invention can relate to hybrid buttons formed from plastic and at least one additional material.

For example, conventional center-mounted buttons on selected models of the iPod™ media player made by Apple Computer, Inc., of Cupertino, Calif. are formed from plastic and incorporate certain design functionality. These buttons include distinct mechanical anti-rotation features that are formed using conventional manufacturing techniques.

Although media players such as these work well, it can be desirable to retain design functionality of the center-mounted button on an iPod™, or other similar media player, while providing the center-mounted button a metallic or other non-plastic cosmetic finish and to provide an improved surface for engaging the button.

SUMMARY OF THE INVENTION

The invention can relate to retaining certain design functionality, such as anti-rotation, of a center-mounted button on an iPod™, or other similar media player, and providing additional functionality, such as forming the center-mounted button in non-planar (e.g., concave) that was previously difficult to manufacture within the design specifications of the button when it was formed wholly in plastic.

In one embodiment, this invention can relate to a portable media player. The portable media player can include a housing, which can include an Input/Output (I/O) platform. The I/O platform can be in the form of one or more buttons.

This invention can also relate to buttons for use in cellular phones, personal digital assistants (PDAs), video games, radios, MP3 players, CD players, DVD players, televisions, game players, cameras, etc.

In one embodiment, a button according to the invention can retain design functionality of the center-mounted button, while providing the center-mounted button a metal or other non-plastic cosmetic finish.

A button according to one embodiment of the invention can also retain various mechanical functions, such as anti-rotation, easily implemented in plastic buttons. A button according to the invention can also provide additional functionality such as providing an upper face formed in a concave shape, such shape that was previously substantially unobtainable within the design specifications of the button when it was formed wholly in a cosmetically-desirable plastic.

A method of manufacturing a button according to one embodiment of the invention can include lathing a non-plastic upper portion of the button whereby the lathing includes forming a reverse flange in the upper non-plastic portion of the button, anodizing the non-plastic upper portion following the forming of the non-plastic upper portion, and injection-molding a plastic lower portion of the button onto the non-plastic upper portion of the button. The injection-molding can include fixing the position of the plastic lower portion with respect to the non-plastic upper portion by injection-molding at least a portion of the lower portion into the reverse flange.

It should be noted that a button according to the invention formed from at least partially from a metallic material may exhibit greater reliability, strength, dependability and electrical properties such as conductivity. Such properties can substantially improve the functionality of the button. Furthermore, a metallic or other non-plastic button may exhibit improved cosmetic properties because the material of the button can be matched to the material of the housing, thereby improving the look and feel of the button and harmonizing the look and feel of the electronic device.

BRIEF DESCRIPTION OF THE DRAWINGS

The following detailed description of the embodiment of the present disclosure can best be understood when read in conjunction with the following drawings in which features are not necessarily drawn to scale but rather are drawn as to best illustrate the pertinent features.

DETAILED DESCRIPTION OF THE INVENTION

Figure 1:
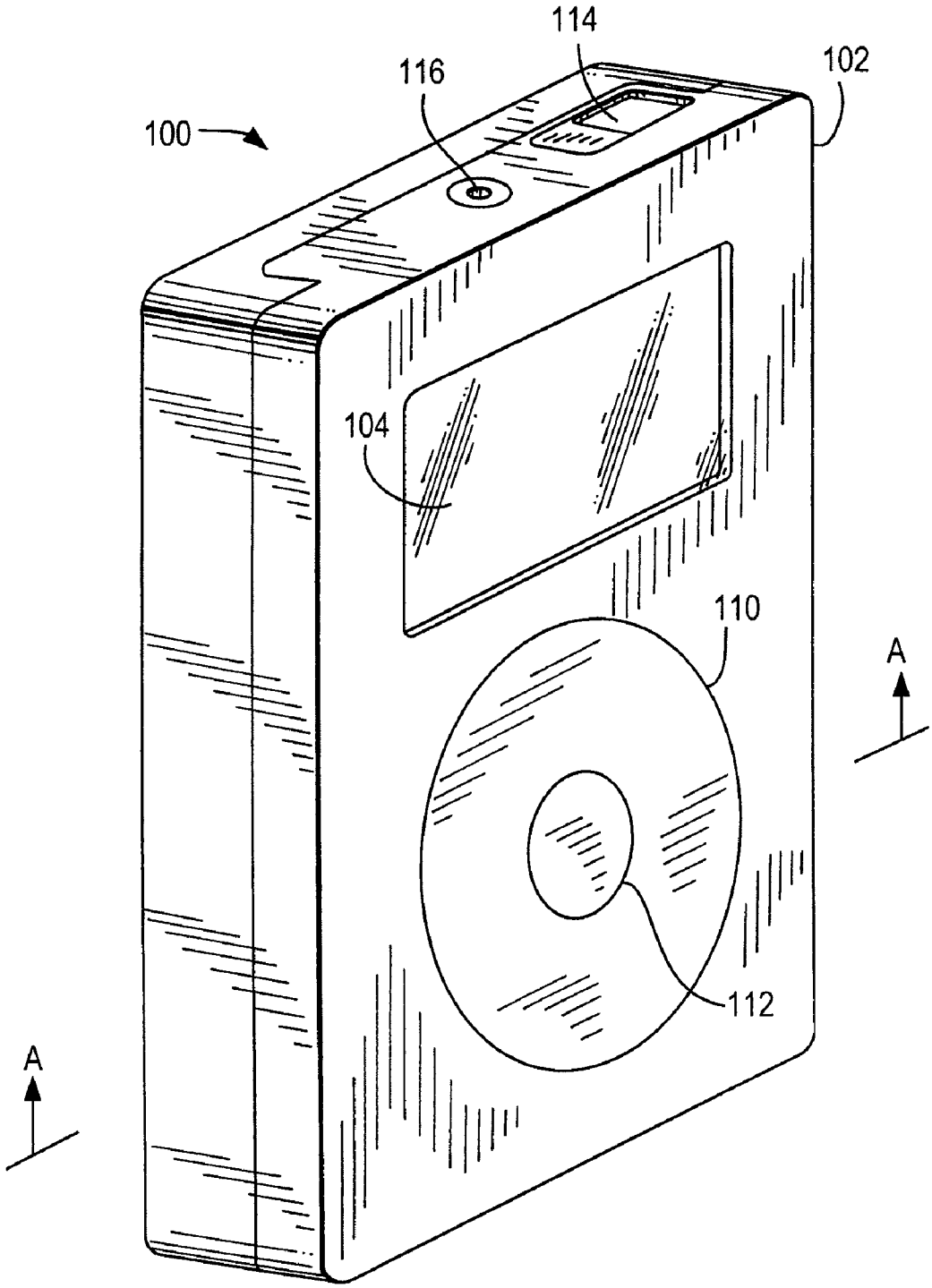
FIG. 1 is a perspective view of a media player according to the invention.

A button according to the invention can include a non-plastic portion formed with a computer-numerically controlled (CNC) lathe and a plastic injection-molded portion that can be injection-molded directly onto the non-plastic portion.

One purpose of the injection-molded center button according to the invention can be to retain all-plastic button design functionality.

In one embodiment, the button can present an anodized aluminum surface or other metallic surface to a user when the non-plastic portion is formed from a metal. The button can also present a rotationally symmetric (e.g., concave) surface to the user while achieving, or even exceeding, the design specifications of the all-plastic button. Additionally, the injection-molded button according to the invention may be produced in relatively high volumes at a relatively low cost to meet high production requirements.

As mentioned above, one method of forming a button is to make a metal portion of the button using a CNC-lathe, which can be used to obtain a button surface shape of a predetermined finish, (e.g., a textured face, a concave face, etc.).

Nevertheless, certain functions (e.g., rotation prevention, adaptability to couple to a specific flexible printed circuit (FPC) relief, such as the ability to provide a space for a portion of the FPC to pass therethrough, retention flange and/or other features) cannot easily be obtained in a part that was completely formed with a CNC-lathe because conventional lathing can only shape the metal portion of the button around a rotational axis. Although features may be added to metal portions through additional processing (e.g., milling), such an addition could be both time consuming and costly.

In one embodiment of the invention, the button can be manufactured as follows: An upper non-plastic portion of the button is formed using a CNC-lathe. The non-plastic portion can be formed to include a machined-concave face. The non-plastic portion can also be further formed to include an undercut retention feature suitable for accepting a plastic ledge. The non-plastic portion can be further formed to incorporate a center button actuator nub on the underside—i.e., the side that faces away from a user—of the button. This non-plastic portion of the button can be finished on the lathe to a very fine finish, and then anodized according to any known anodization processes.

The finished anodized part can then be placed in an injection-molding cavity of an injection-molding machine. An additional plastic element (or elements) can then be injection-molded onto the underside of the non-plastic portion of the button (or, in alternative embodiments, on any suitable location on the button).

Alternatively, other embodiments of the invention can include an all-metal button that does not include an anti-rotation feature but does include FPC relief, which was machined or coined into the retainer plate on the underside of the button.

Yet another aspect of the invention relates to the additional advantages obtained by forming at least a portion of the button from a material other than plastic. For example, plastic iPod™ buttons formed from commercially-available resins such as ABS, PC, AND ABS-PC, are normally only formed at thicknesses of greater than 0.5 millimeters. When the plastic button is formed thinner than 0.5 millimeters, surface quality can degrade at least because the actuator nub, which is typically formed on the underside of the button, can show through to the concave face of the button because of limitations in the flow of the plastic. A button formed according to the invention, however, can be formed at thicknesses of about 0.5 millimeters, about 0.3 millimeters, or even less, because of superior metallic and/or other non-plastic properties and processing.

A number of embodiments of this invention are described below with reference to FIGS. 1-9. However, those skilled in the art will readily appreciate that the detailed description given herein with respect to these figures is for explanatory purposes as the invention extends beyond these limited embodiments.

FIG. 1 is a top plan view of a center button housed in a media player 100 according to one embodiment of the invention. The term "media player" generally refers to computing devices that are dedicated to processing media such as audio, video or other images, as for example, music players, game players, video players, video recorders, cameras, and the like. In some cases, the media players may perform a single functional (e.g., a media player dedicated to playing music) and in other cases perform multiple functions (e.g., a media player that plays music, displays video, stores pictures, and the like). In either case, these devices are generally portable so as to allow a user to listen to music, play games or video, record video or take pictures wherever the user travels. Alternatively, the devices that incorporate a button according to this invention may not be portable at all.

Electronic device 10 can also be any handheld, or miniature consumer electronic device. Miniature electronic devices may have a form factor that is smaller than that of hand-held devices. Illustrative miniature electronic devices can include, but are not limited to, watches, rings, necklaces, belts, accessories for belts, headsets, accessories for shoes, virtual reality devices, other wearable electronics, accessories for sporting equipment, accessories for fitness equipment, or combinations thereof.

In the illustrated embodiment in FIG. 1, media player 100 can be a pocket-sized hand-held MP3 music player that allows a user to store a collection of music (e.g., in some cases up to 4,000 CD-quality songs). Although used primarily for storing and playing music, the MP3 music player shown herein can also include additional functionality, such as storing a calendar and phone lists, storing and playing games, storing photos, and the like.

FIG. 1 also shows housing 102, display screen 104, scroll wheel 110, concave-faced upper non-plastic portion of center button 112, that can be used for user navigation through a user interface, holdswitch 114, and earphone jack 116 of media player. Housing 102 can host center button 112, and can in fact be configured to retain scroll wheel 110 in its position in the media player. The navigation can be implemented in the form of transmission of user instructions in response to user stimulus on scroll wheel 110.

Scroll wheel 110, which can alternatively be referred to herein as a touchpad, is an intuitive interface that can provide easy one-handed operation i.e., it lets a user interact with the media player with one or more fingers. Scroll wheel 110 can be configured to provide one or more control functions associated with the media player.

In one embodiment of the invention, button 112 can be implemented without scroll wheel 110. Alternatively, the position of button 112 can be widely varied relative to scroll wheel 110 and housing 102. For example, they can be adjacent one another or spaced apart. In the illustrated embodiment, button 112 is configured to be surrounded by scroll wheel 110. In this manner, button 112 can provide a tangible surface that defines the inner boundary of scroll wheel 110. Alternatively, a single device may have multiple buttons (not shown). By way of example, a plurality of buttons can include a menu button, a play/stop button, a forward seek button and a reverse seek button, and the like. Additionally, button 112 can be placed at any external surface (e.g., top, side, front, or back) of housing 102 that is accessible to a user during manipulation of the media player. Furthermore, button 112 can be integrated with scroll wheel 110, as shown in FIG. 1, or with some other user interface feature on the media player, such as switches, keys, dials, trackballs, joysticks, touch pads, touch screens, displays, microphones, speakers, cameras and the like. Each of these individual interfaces may include buttons either incorporate therein such as a button on a joystick, or forming an integral part thereof such as a switch with button located thereon or a touch screen or touch pad with a button located therewithin which may not operate similar to the touch pad—i.e., in a touch-sensitive fashion but can operate in response to a mechanical force.

Further, button 112 can be configured to provide one or more dedicated control functions for making selections or issuing commands associated with operating the media player. By way of example, in the case of an MP3 music player, the button functions can be associated with opening a menu, playing a song, fast forwarding a song, seeking through a menu and the like. In most cases, the button functions are implemented via a mechanical clicking action. For example, dome switch 210 in FIG. 2 can be configured to produce a mechanical and/or audible clicking action upon actuation.

Housing 102 can include integrated circuit chips and other circuitry. Such circuitry can include a microprocessor (e.g., CPU), memory (e.g., ROM, RAM), a power supply (e.g., battery), a circuit board, a hard drive, other memory (e.g., flash) and/or various I/O support circuitry. The electrical components can also include components for inputting or outputting music or sound such as a microphone, amplifier and a digital signal processor (DSP). The electrical components can also include components for capturing images such as image sensors (e.g., charge coupled device (CCD) or include complimentary oxide semiconductor (CMOS)) or optics (e.g., lenses, splitters, filters etc.). The electrical components can also include components for sending and receiving media (e.g., antenna, receiver, transmitter, transceiver, etc.).

A user interface for the media player can be formed from button 112 and scroll wheel 110, among other things, such as a speaker for audible feedback or a vibratory mechanism for providing tactile feedback. While the user interface can be widely varied, this invention can relate to the implementation of buttons on a number of user interface variations. Such variations, which are described in greater detail above, can include buttons implemented on switches, keys, dials, trackballs, joysticks, touch pads, touch screens, displays, microphones, speakers, cameras and the like.

Figure 2:
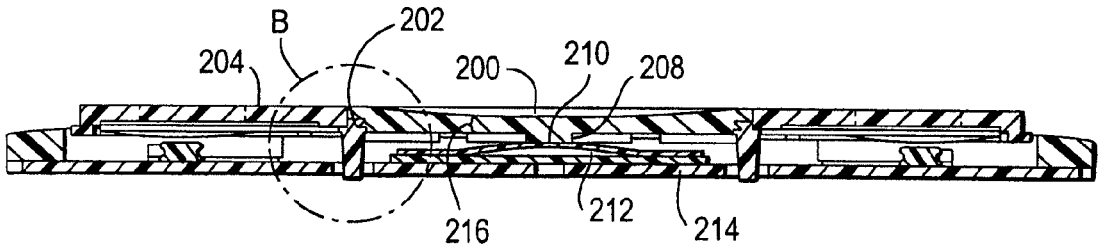
FIG. 2 is an enlarged cross-sectional of a button and scroll wheel according to the invention taken from line A-A of FIG. 1.

FIG. 2 is an enlarged cross-sectional view of a center button and scroll wheel according to the specific embodiment of the invention taken from line AA of FIG. 1. The button shown in FIG. 2 can include non-plastic portion 200, which can itself have a concave surface actuator nub 208 on the underside of non-plastic portion 200.

FIG. 2 also shows plastic portion 202 of the center button. Plastic portion 202 can be injection-molded onto non-plastic portion 200 after non-plastic portion 200 is made. The interconnection between non-plastic portion 200 and plastic portion 202 is enlarged in FIG. 3 and described in greater detail below.

FIG. 2 also shows scroll wheel 204 and center dome switch 210, which can be located on FPC 212, which, in turn, can be located on back plate 214. Actuator nub 208 can be actuated to activate dome switch 210. FIG. 2 also shows the thickness of annulus 216, which can be lathed to a thickness of less than 0.5 millimeters and, in some embodiments, between about 0.3 millimeters and about 0.5 millimeters while still providing the desired functionality typically associated with an all-plastic button.

Figure 3:
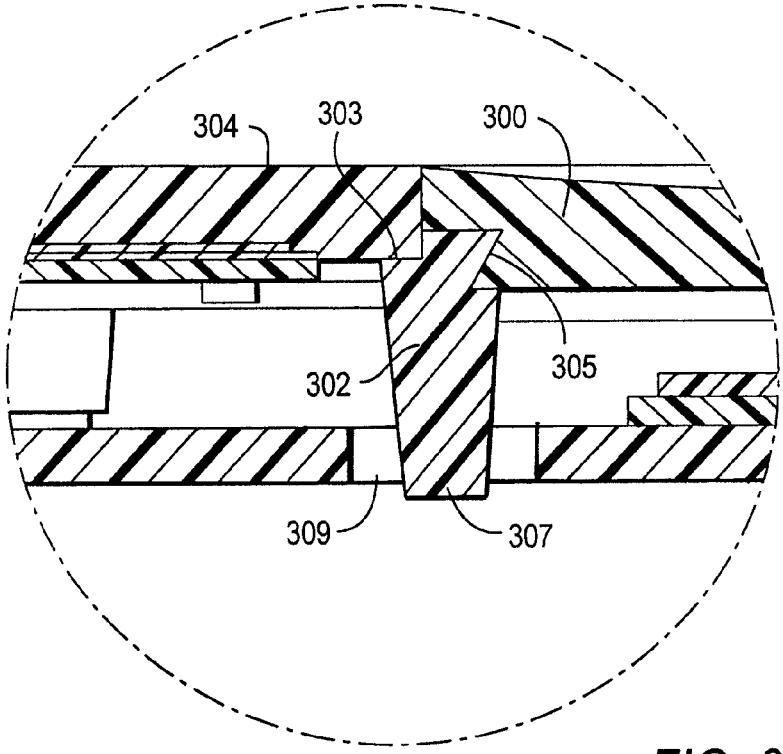
FIG. 3 is an enlarged view of a cut-out portion taken from line B of FIG. 2.

FIG. 3 is an enlarged view of a cut-out portion of FIG. 2 taken from line B. FIG. 3 shows non-plastic portion 300 of center button 112, plastic portion 302 of center button 112, and flange 303 formed in plastic portion 302 that abuts against the underside of scroll wheel 304. Flange 303 can allow scroll wheel 304 to maintain center button 112 in a stationary position in the plane of the button.

FIG. 3 also shows reverse flange 305 in non-plastic portion 300 that creates a mechanical undercut so that plastic portion 302 does not separate from non-plastic portion 300 after molding. Plastic portion 302 also can include one or more anti-rotation legs 307 that can extend downward into the device. Legs 307 can limit or prevent rotation of the button with respect to the device. This concern is especially significant when the button is centered in a scroll wheel because 10 the rotation of a user's finger around a scroll wheel can provide rotational forces to the button.

Figure 6:
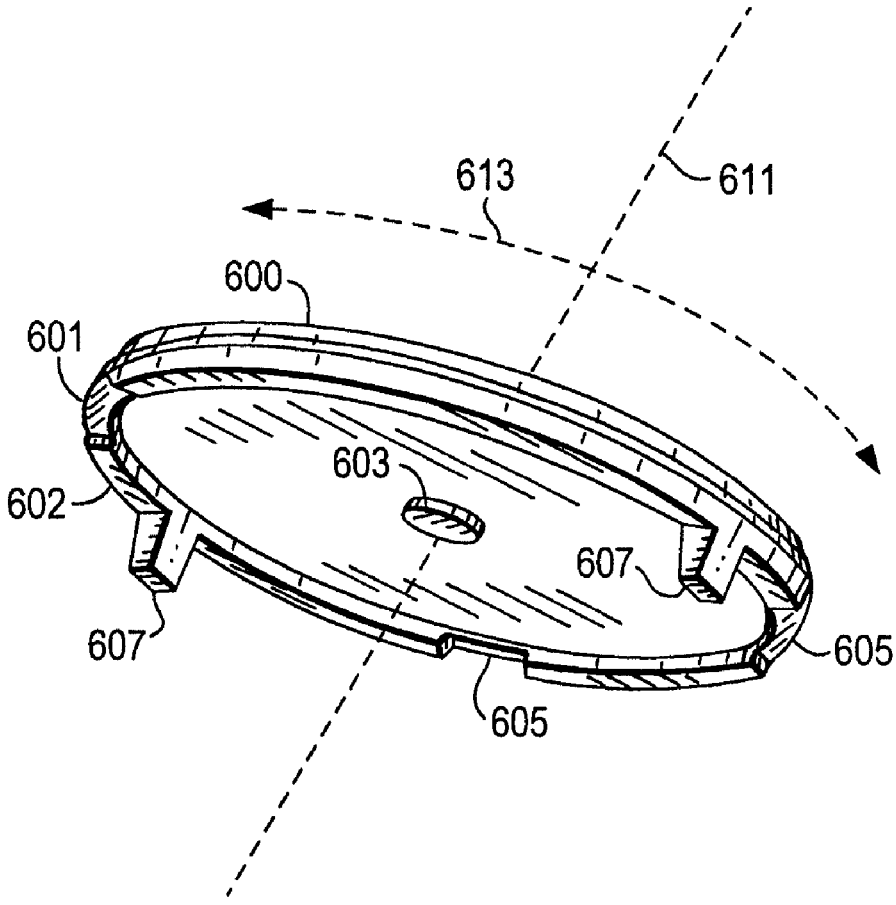
FIG. 6 is a perspective view shown from below of a button according to the invention.

FIG. 3 also shows apertures 309 located in the back plate for anti-rotation legs to pass through and to be constrained therein from rotating along a rotational axis about a longitudinal axis (see rotational axis 613 shown in FIG. 6).

Figure 4:
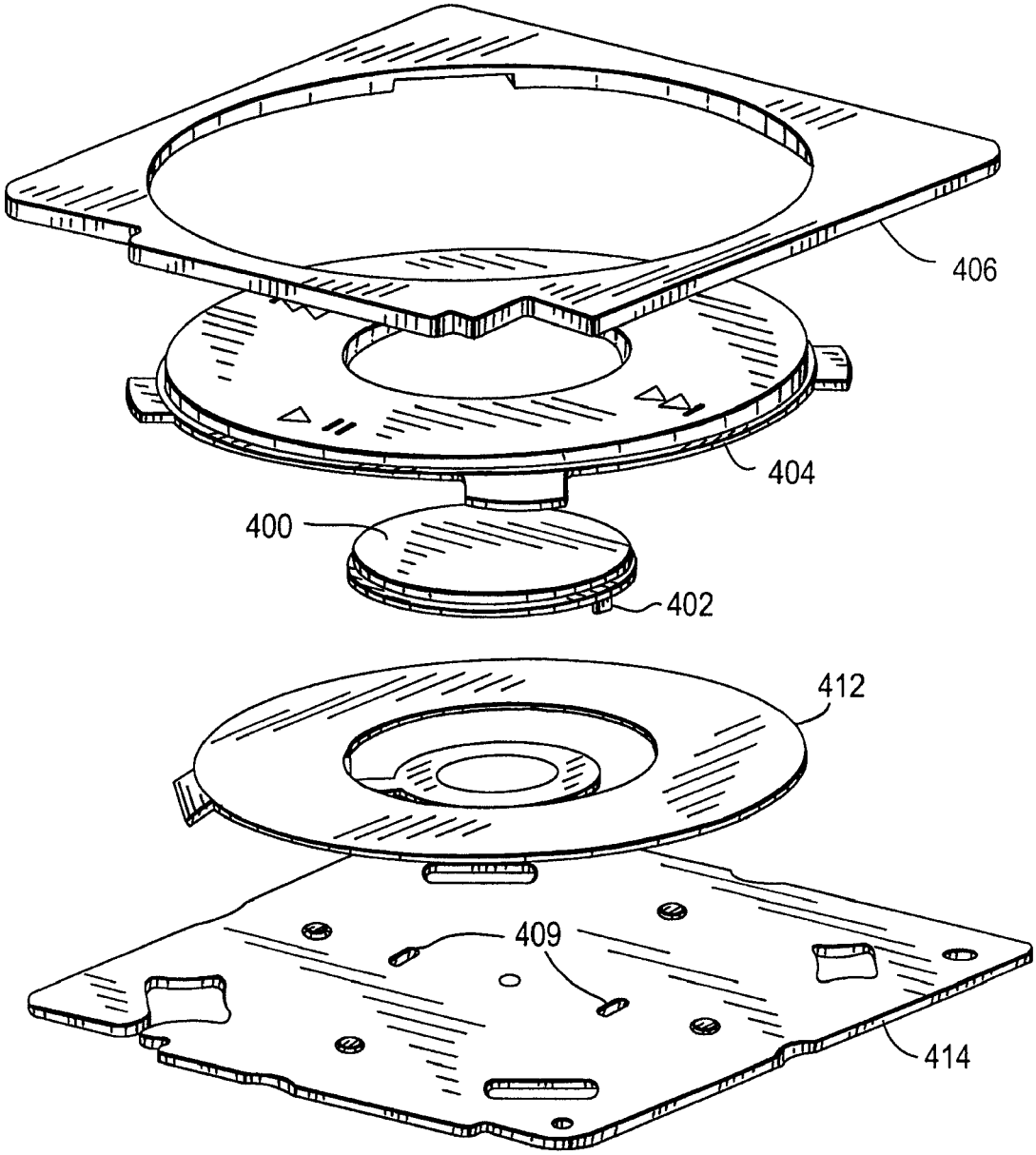
FIG. 4 is an exploded perspective view of the components of a button according to the invention.

FIG. 4 is an exploded perspective view of the components of a center-mounted button according to one embodiment of the invention. FIG. 4 illustrates center button 402 according to the invention, scroll wheel 404, scroll wheel retainer 406, anti-rotation apertures 409, FPC 412 including dome switches, and retainer plate 414.

Figure 5:
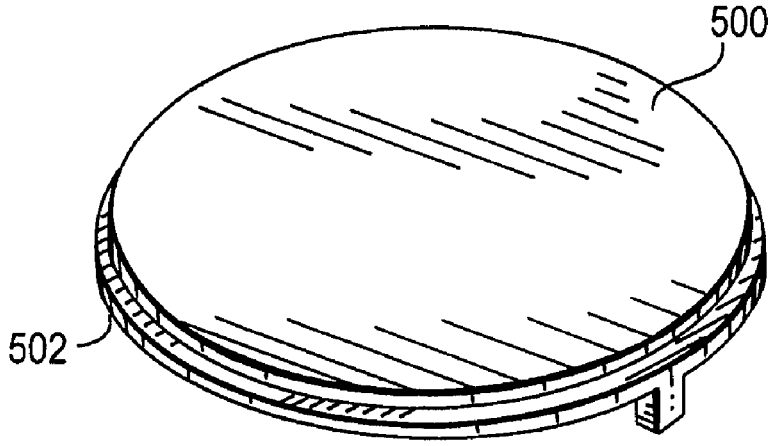
FIG. 5 is a perspective view shown from above of the button according to the invention.

FIG. 5 is a perspective view of the button according to one embodiment of the invention shown from above. FIG. 5 shows non-plastic portion of button 500, and plastic portion of button 502.

FIG. 6 is a perspective view of the button according to one embodiment of the invention shown from below. FIG. 6 shows non-plastic portion 600 of the button according to the invention, plastic portion 602, FPC tail relief 601, center button dome switch actuator nub 603 formed on the underside of non-plastic portion 600, gating spots 605 for additional circuitry and anti-rotation legs 607. FIG. 6 also shows longitudinal axis 611 of the button as well. Furthermore, FIG. 6 shows rotational axis 613 of the button. While the button according to the invention may not rotate about rotational axis 613, nevertheless rotational axis 613 has been shown to illustrate the direction of the forces that anti-rotation legs 607 counteract. Rotational axis 613 has also been shown to illustrate the axis in which designs can be implemented using a CNC-lathe, as described in more detail above. It can be seen from this perspective that lower plastic portion 602 has been injection-molded into the reverse flange of upper non-plastic portion 600. Once molded, the reverse flange can substantially trap lower plastic portion 602 from moving with respect to upper non-plastic portion 600. Furthermore, the reverse flange can make it difficult to remove lower plastic portion 602, or to replace lower plastic portion 602 once removed.

Figure 7:
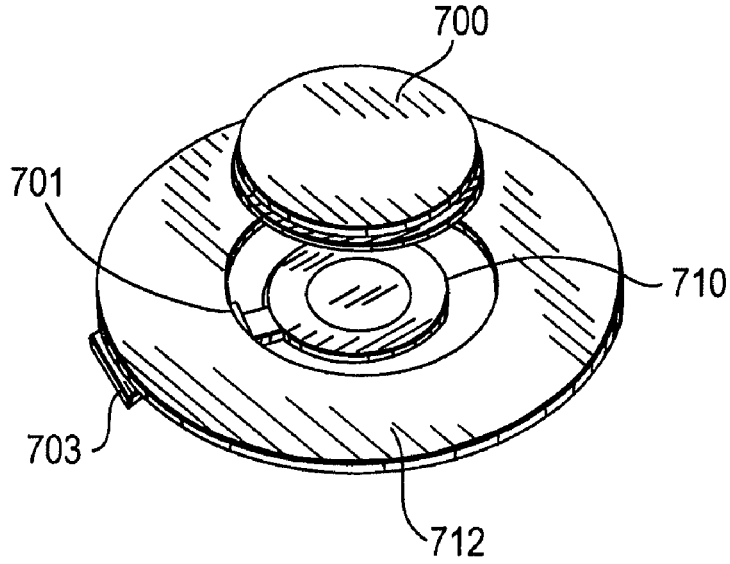
FIG. 7 is an exploded perspective view of the center molded button and flexible printed circuit according to the invention.

FIG. 7 is an exploded perspective view of the center molded button and flexible printed circuit according to the invention. FIG. 7 shows button's non-plastic portion 700, tail 701 from the center dome switch 710 that runs through FPC tail relief 601 (shown in FIG. 6 and also in FIG. 8 as FPC tail relief 806), tail 703 that can transmit signals to the main logic board (not shown) and FPC 712 that can include the dome switches.

In other embodiments of the invention, a media player can include an all-metal button that does not include an anti-rotation feature but does include FPC relief which was machined or coined into the retainer plate on the underside of the button.

Figure 8:
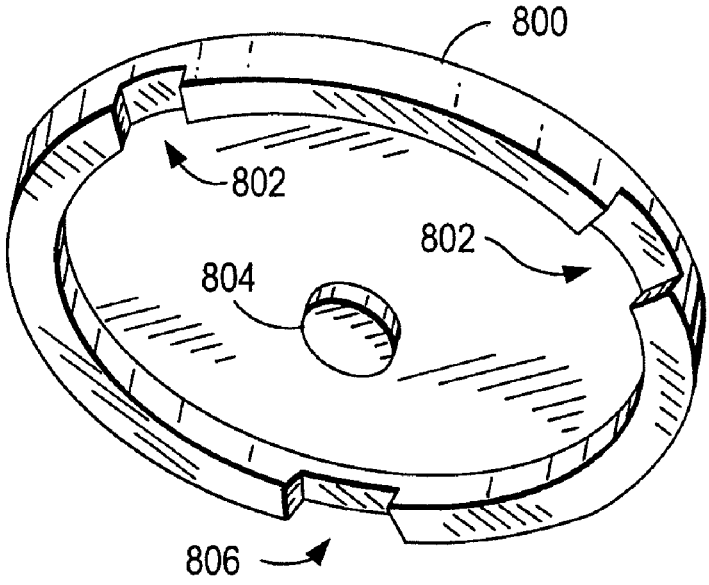
FIG. 8 is a perspective view shown from below of another embodiment of a button according to the invention.

FIG. 8 shows an exemplary illustration of an all-metal button 800 according to the aforementioned embodiments. While button 800 does not include the anti-rotation legs shown in other embodiments above, button 800 does incorporate gating spots at 802, dome switch actuator nub 804 and FPC tail relief 806. In a method according to the embodiment, FPC relief 806 can be coined or machined into the surface of button 800 before, after, or, in some embodiments during certain aspects of the lathing process.

While this invention has been described in terms of several preferred embodiments, there are alterations, permutations, and equivalents, which fall within the scope of this invention. For example, although the invention has been largely described in terms of a music player, it should be appreciated that the invention can also be applied to other types of devices.

Figure 9:
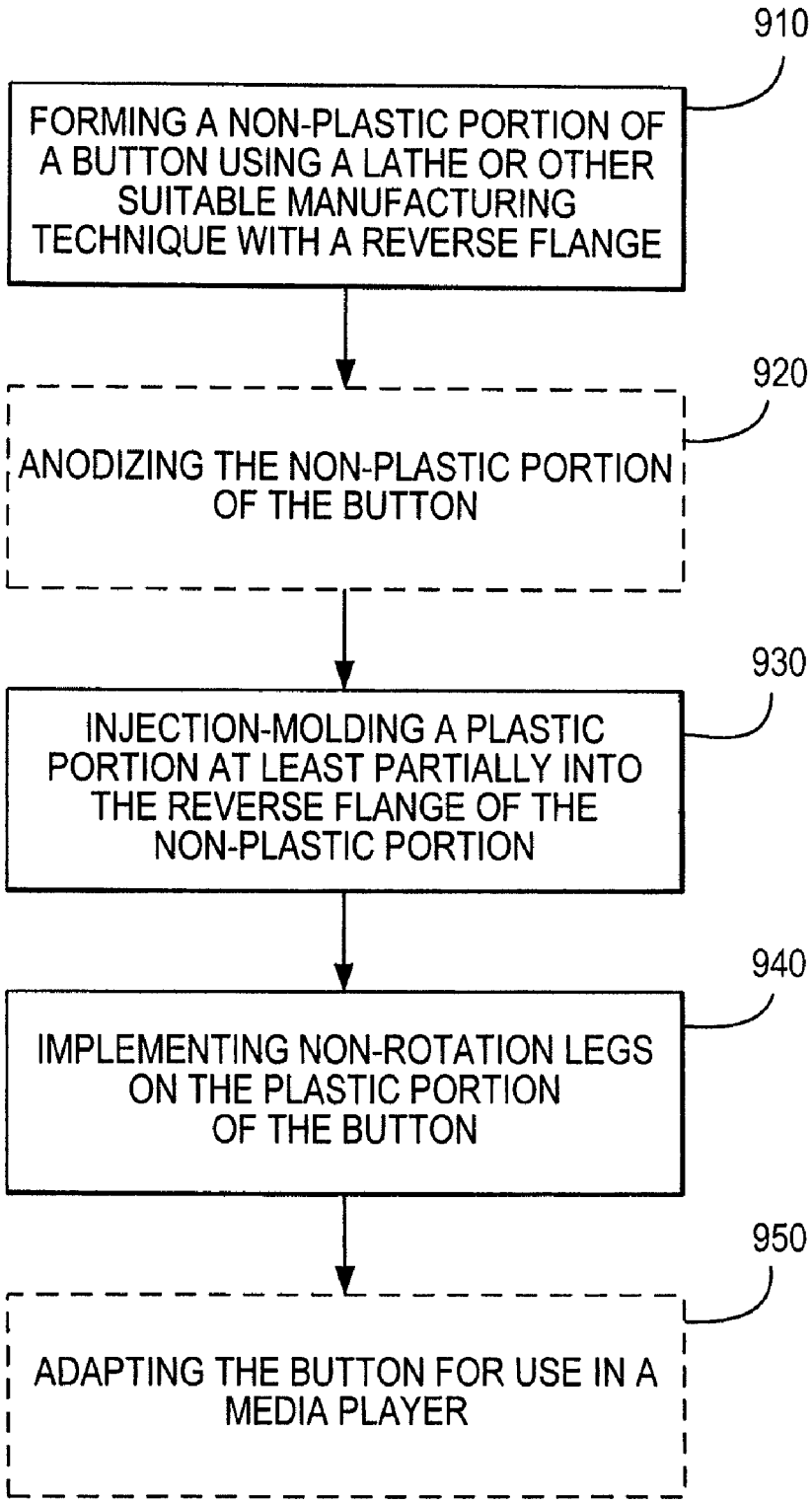
FIG. 9 is a flowchart of possible embodiments of methods according to the invention.

FIG. 9 shows various embodiments of a method according to the invention. Step 910 shows forming a non-plastic portion of a button using a lathe or other suitable manufacturing technique with a reverse flange. Step 920, which is shown to be an optional step by the dotted lines, shows anodizing the non-plastic portion of the button. Anodizing may be implemented on a metallic surface. Step 930 shows injection-molding a plastic portion at least partially into the reverse flange of the non-plastic portion. Step 940 shows implementing non-rotation legs on the plastic portion of the button. Step 950 shows the optional step of adapting the button for use in a media player. Such adapting may take the form of configuring the plastic portion of the button with certain gating spots or FPC relief in order to make the button usable with certain circuitry or adjusting the button in some other suitable fashion.

The method according to the invention can preferably implemented by a combination of hardware and software, but can also be implemented in hardware or software. The method can also be embodied as computer readable code on a computer readable medium. The computer readable medium is any data storage device that can store data which can thereafter be read by a computer system. Examples of the computer readable medium include read-only memory, random-access memory, hard drive, flash memory, CD-ROMs, DVDs, magnetic tape, optical data storage devices, and carrier waves.

In yet another alternative embodiment of the invention, the plastic portion of the button may be implemented using rubber or other material that is more flexible than some types of injection-molded plastic. In such an embodiment, the more flexible material would not have to be injected-molded onto the other portion (hereinbefore referred to as the "non-plastic" portion) of the button. Rather, the material could be stretched onto the reverse flange of the other portion of the button providing that the flexible portion retained sufficient grip on the reverse flange of the other portion of the button to remain stationary with respect to the other portion of the button for an extended time.

It is therefore intended that the following appended claims be interpreted as including all such alterations, permutations, and equivalents as fall within the true spirit and scope of the present invention. The embodiments described herein-above are further intended to explain the best modes known of practicing the invention and to enable others skilled in the art to utilize the invention in such, or other embodiments and with the various modifications required by the particular applications or uses of the invention.

Accordingly, the description is not intended to limit the invention to the form disclosed herein. Also, it is intended that the appended claims be construed to include alternative embodiments.

The invention claimed is:

1. A button comprising: a first portion and a second portion, the first portion comprising a plastic portion and the second portion comprising a metal portion, the plastic portion comprising a band around a periphery of the metal portion, the metal portion of the button being matched to a metal material of a housing hosting the button.

2. The button of claim 1 wherein the plastic portion comprises a flange that is operative to interlock with a surface and the flange prevents movement of the button along a longitudinal axis of the button.

3. The button of claim 1, wherein the metal portion comprises a centrally-located nub on the underside of the metal portion and operative to actuate a dome switch.

4. The button of claim 1, wherein the metal portion comprises an annulus with a thickness along a longitudinal axis of between about 0.3 millimeters and about 0.5 millimeters.

5. The button of claim 1, wherein the metal portion comprises an annulus along a longitudinal axis of the button of less than about 0.5 millimeters.

6. The button of claim 1, wherein the metal portion is formed on a computer-numeric controlled lathe.

7. The button of claim 1 wherein the metal portion comprises anodized aluminum.

8. A button comprising: a metal upper portion comprising an annulus with a thickness along a longitudinal axis of between 0.3 millimeters and 0.4 millimeters, the metal upper portion being shaped on a lathe to provide an external surface to be presented to a user and an underside with a centrally-located nub operative to actuate a switch, and a plastic lower portion, a portion of the plastic lower portion being injection-molded, wherein the position of the plastic lower portion is fixed with respect to the metal upper portion and the metal upper portion of the button is matched to a metal material of a housing hosting the button.

9. The button of claim 8, wherein the plastic lower portion comprises a flange that is operative to interlock with a surface and the flange prevents upward movement of the button along a longitudinal axis of the button.

10. The button of claim 8, wherein the metal upper portion comprises a centrally-located nub on the underside of the metal upper portion that is operative to actuate a dome switch.

11. The button of claim 8 wherein the metal upper portion comprises anodized aluminum.

12. An electronic device comprising: a base plate comprising multiple apertures, a flexible printed circuit board that is operative to receive user stimulus and transmit user commands to a microprocessor in response to the stimulus, and a button comprising a metal upper portion, the metal upper portion of the button being matched to a metal material of a housing hosting the button, a plastic lower portion, the plastic lower portion being injection-molded and configured to pass through the multiple apertures, the multiple apertures configured to constrain the button from rotating, and an actuator nub that actuates a switch on the flexible printed circuit when the button is depressed.

13. The device of claim 12, wherein the plastic lower portion comprises a flange that is operative to interlock with a surface and the flange prevents movement of the button along a longitudinal axis of the button.

14. The device of claim 12, wherein the metal upper portion comprises a centrally-located nub on the underside of the metal upper portion and operative to actuate a dome switch.

15. The device of claim 12, wherein the metal upper portion comprises an annulus with a thickness along a longitudinal axis of between about 0.3 millimeters and about 0.5 millimeters.

16. The device of claim 12, wherein the metal upper portion comprises an annulus along a longitudinal axis of the button of less than about 0.5 millimeters.

17. The device of claim 12, wherein the metal upper portion comprises anodized aluminum.

* * * * *